US008771908B2

(12) United States Patent
Abe

(10) Patent No.: US 8,771,908 B2
(45) Date of Patent: Jul. 8, 2014

(54) ELECTROPHOTOGRAPHIC APPARATUS AND ELECTROPHOTOGRAPHIC PHOTOSENSITIVE MEMBER

(75) Inventor: Yukihiro Abe, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 240 days.

(21) Appl. No.: 13/107,425

(22) Filed: May 13, 2011

(65) Prior Publication Data

US 2011/0287350 A1 Nov. 24, 2011

(30) Foreign Application Priority Data

May 18, 2010 (JP) ..... 2010-114820
Apr. 12, 2011 (JP) ..... 2011-088443

(51) Int. Cl.
*G03G 15/00* (2006.01)

(52) U.S. Cl.
USPC ..... 430/60; 430/56; 399/159

(58) Field of Classification Search
USPC ..... 430/56, 60–64; 399/111, 159
See application file for complete search history.

(56) References Cited

U.S. PATENT DOCUMENTS 3,622,319 A 11/1971 Sharp
3,721,584 A 3/1973 Diem
5,352,555 A * 10/1994 Yagi et al. ..... 430/62
5,707,767 A 1/1998 Yu
2004/0232415 A1* 11/2004 Aoki et al. ..... 257/53
2006/0194132 A1 8/2006 Hosoi
2009/0297217 A1* 12/2009 Iwanaga et al. ..... 399/111

FOREIGN PATENT DOCUMENTS

JP 62-040468 A 2/1987
JP 4-355403 A 12/1992
JP 05-049108A A 2/1993

* cited by examiner

*Primary Examiner* — Mark F Huff
*Assistant Examiner* — Rashid Alam
(74) *Attorney, Agent, or Firm* — Canon USA, Inc. IP Division

(57) ABSTRACT

An electrophotographic apparatus and an electrophotographic photosensitive member for use in the electrophotographic apparatus are provided. The number of intermediate layers between a photoconductive layer and a surface layer is an odd number more than 2, and the refractive index monotonically decreases from the photoconductive layer toward the surface layer. The refractive index of an odd-numbered intermediate layer is in a predetermined range of the geometrical mean of the refractive indices of the two layers adjacent to the odd-numbered intermediate layer, and the product of the refractive index and the thickness is in a specific range of an odd multiple of $\lambda/4n$. The sum of the products of the refractive indices and the thicknesses of one or more intermediate layers disposed between at least two odd-numbered intermediate layers is in a range of $-\pi/2<\theta<\pi/2$ in the terms of phases.

20 Claims, 16 Drawing Sheets

SURFACE LAYER (n4)
3RD LAYER (n3, d3)
INTERMEDIATE LAYERS
PHOTO-CONDUCTIVE LAYER (n0)
1ST LAYER (n1, d1)
2ND LAYER (n2, d2)
r(4,3)
r(3,2)
r(2,1)
r(1,0)

Im
Re
r3
r1
r(3,2)
r(2,1)
r(1,0)
r(4,3)

Im
Re
r(3,2)
r(2,1)
r(4,3)
r(1,0)

Im
Re
r(1,0)
r1
r3
r(2,1)
r(3,2)
r(4,3)

SURFACE LAYER (n4)
3RD LAYER (n3, d3)
INTERMEDIATE LAYERS
PHOTO-CONDUCTIVE LAYER (n0)
2ND LAYER (n2, d2)
1ST LAYER (n1, d1)
r(4,3)
r(3,2)
r(2,1)
r(1,0)

Im
Re
r(2,1)
r3
r1
r(1,0)
r(3,2)
r(4,3)

Im
Re
r(2,1)
r(3,2)
r(1,0)
r(4,3)

Im
Re
r(2,1)
r1
r3
r(3,2)
r(1,0)
r(4,3)

ELECTROPHOTOGRAPHIC APPARATUS AND ELECTROPHOTOGRAPHIC PHOTOSENSITIVE MEMBER

BACKGROUND OF THE INVENTION

1. Field of the Invention

The present invention relates to an electrophotographic apparatus and an electrophotographic photosensitive member.

2. Description of the Related Art

An electrophotographic photosensitive member is employed in various steps, such as charging, image exposure, development, transferring, and cleaning, so the surface of the electrophotographic photosensitive member is worn with use. To address this, a technique for providing an electrophotographic photosensitive member with a surface layer resistant to wearing in order to enable the electrophotographic photosensitive member to withstand long term use has become practical. However, even if such a surface layer resistant to wearing is provided, wearing still exists and the surface layer is gradually worn by long use.

For example, in the case of an electrophotographic photosensitive member that includes a photoconductive layer made of amorphous silicon, a technique for providing a surface layer made of amorphous silicon carbide on the photoconductive layer has become practical. As in this case, if the photoconductive layer and the surface layer are made of different materials, because the materials have different refractive indices, part of an image exposure beam is reflected at the interface between the photoconductive layer and the surface layer. For the same reason, part of the image exposure beam is also reflected at the interface between the surface layer and the air. These two reflected beams interfere with each other, and the interference conditions are chiefly determined by the refractive index and thickness of the surface layer. As a result, if the surface layer is worn with use, the interference conditions vary, the light quantity of the image exposure beam reaching the photoconductive layer inevitably changes, and the sensitivity of the electrophotographic photosensitive member varies.

Here, reflection occurring at interfaces between multiple films in which layers of different refractive indices are laminated is described.

When a beam impinges on an interface between two layers of different refractive indices, part of the incident beam is reflected at the interface. Specifically, as illustrated in FIG. 4A, when a beam impinges on a layer of refractive index $n_2$ at an angle of incidence $\theta_1$ from a layer of refractive index $n_1$, amplitude reflectance r and amplitude transmittance t can be represented from Fresnel equations by the following expressions (12) to (15), where the angle of refraction is $\theta_2$.

For an S wave, in which a plane of incidence is perpendicular to a plane of polarization:

$$r = \frac{n_1 \cdot \cos\theta_1 - n_2 \cdot \cos\theta_2}{n_1 \cdot \cos\theta_1 + n_2 \cdot \cos\theta_2} \tag{12}$$

$$t = \frac{2 \cdot n_1 \cdot \cos\theta_1}{n_1 \cdot \cos\theta_1 + n_2 \cdot \cos\theta_2} \tag{13}$$

For a P wave, in which a plane of incidence is parallel to a plane of polarization:

$$r = \frac{n_1/\cos\theta_1 - n_2/\cos\theta_2}{n_1/\cos\theta_1 + n_2/\cos\theta_2} \tag{14}$$

$$t = \frac{2 \cdot n_1/\cos\theta_1}{n_1/\cos\theta_1 + n_2/\cos\theta_2} \tag{15}$$

From Snell's law, the angle of incidence $\theta_1$ and the angle of refraction $\theta_2$ satisfy the following expression (16):

$$\frac{\sin\theta_1}{\sin\theta_2} = \frac{n_2}{n_1} \tag{16}$$

An electrophotographic apparatus typically exposes an electrophotographic photosensitive member with an image exposure beam for forming a latent image on the surface of the electrophotographic photosensitive member at an angle nearly perpendicular thereto. Specifically, typical angles of incidence in exposure are approximately ±15° in a main scanning direction and approximately 5° or less in a sub scanning direction. A typical refractive index of a material used in the surface layer of the electrophotographic photosensitive member is 1.5 or more. If amorphous silicon carbide is used as the material of the surface layer, because the refractive index is 1.9 or more, a beam passing through the surface layer is incident on a lower layer at an angle less than 10°. Accordingly, when reflection at an intermediate layer between the surface layer and the photoconductive layer is considered, no great problem occurs if $\theta_1=\theta_2\approx 0$. From this approximation, the amplitude reflectance r and the amplitude transmittance t can be represented by the following expressions (17) and (18):

$$r = \frac{n_1 - n_2}{n_1 + n_2} \tag{17}$$

$$t = \frac{2 \cdot n_1}{n_1 + n_2} \tag{18}$$

The reflected beam intensity R is $|r|^2$, and the transmitted beam intensity T is 1−R.

From the foregoing, it is revealed that the reflected beam intensity at an interface is determined by the refractive indices of two materials of media of the interface. When the amplitude reflectance r is positive, the phase of an incident beam and that of a reflected beam match with each other; when the amplitude reflectance r is negative, the phase of an incident beam and that of a reflected beam are shifted by π. Accordingly, when a beam impinges on a high-refractive-index layer from a low-refractive-index layer, the phase difference between a reflected beam and an incident beam is π; when a beam impinges on a low-refractive-index layer from a high-refractive-index layer, the phase difference between a reflected beam and an incident beam is 0.

There is a known technique of providing an antireflective layer between two layers of different refractive indices to reduce reflection of a beam occurring at the interface between the two layers. For example, as illustrated in FIG. 4B, if a single antireflective layer is disposed between a layer of refractive index $n_1$ and a layer of refractive index $n_2$, reflection of an incident beam of wavelength λ can be prevented when the refractive index $n_3$ and the thickness $d_3$ of the antireflective layer satisfy the following expressions (19) and (20), respectively:

$$n_3 = \sqrt{n_1 \cdot n_2} \tag{19}$$

$$d_3 = \frac{\lambda}{4 \cdot n_3} \tag{20}$$

Under the above conditions, a reflected beam at an interface A between the layer of refractive index $n_1$ and the antireflective layer of refractive index $n_3$ and a reflected beam at an interface B between the antireflective layer of refractive index $n_3$ and the layer of refractive index $n_2$ cancel each other out, the interfaces being produced by the provision of the antireflective layer of refractive index $n_3$. The amplitude reflectance when a beam incident from a direction substantially perpendicular to an interface is reflected at the interface can be calculated from the above expression (17). Therefore, the amplitude reflectance $r_A$ at the interface A and the amplitude reflectance $r_B$ at the interface B can be calculated from the following expressions (21) and (22):

$$r_A = \frac{n_1 - n_3}{n_1 + n_3} \tag{21}$$

$$r_B = \frac{n_3 - n_2}{n_3 + n_2} \tag{22}$$

When the antireflective layer of refractive index $n_3$ satisfies the above-described thickness condition, the phase difference between the reflected beam at the interface A and that at the interface B is $\pi$ because of the difference in optical past length. Accordingly, if the magnitudes of $r_A$ and $r_B$ are equal, because $r_A$ and $r_B$ are cancelled out, a combined reflected beam is 0.

When the above expressions (21) and (22) are substituted into $r_A = r_B$, it is found that the refractive index $n_3$ satisfies the above expression (19).

Japanese Patent Laid-Open No. 62-40468 discloses an electrophotographic photosensitive member that includes an antireflective layer for use in suppressing a variation in sensitivity of the electrophotographic photosensitive member.

The provision of an antireflective layer between a surface layer and a photoconductive layer can suppress a reflected beam between the surface layer and the photoconductive layer, prevent interference with a reflected beam at the interface between the surface layer and the air, and suppress a variation in sensitivity of the electrophotographic photosensitive member even if the surface layer is worn. Japanese Patent Laid-Open No. 62-40468 discloses an antireflective layer having a refractive index and a thickness that satisfy the above expressions (19) and (20), respectively, and also discloses an example in which the antireflective layer has a three-layer structure.

Japanese Patent Laid-Open No. 4-355403 discloses, as an example antireflective layer having a three-layer structure, an antireflective layer consisting of a first low-refractive-index layer, a second high-refractive-index layer, and a third low-refractive-index layer arranged in this order from the substrate side.

As in the related art, if an antireflective layer whose refractive index and thickness are optimized is provided between a surface layer and a photoconductive layer, reflection at the interface between the surface layer and the photoconductive layer can be suppressed. As a result, a variation in sensitivity of the electrophotographic photosensitive member to an image exposure beam having a predetermined wavelength can be suppressed.

However, a semiconductor laser frequently used as a light source for an image exposure beam in an actual electrophotographic apparatus often has a half-width of approximately plus or minus several nanometers with respect to a central oscillation wavelength, and a light-emitting diode (LED) often has a half-width of approximately 20 nm. It also has been known that an oscillation wavelength of a semiconductor laser has a temperature dependence of approximately 0.2 nm/° C. (e.g., 10 nm for a difference of 50° C.). Accordingly, a variation in sensitivity of an electrophotographic photosensitive member to an image exposure beam having a wavelength in a range from approximately 10 nanometers to several tens of nanometers is suppressed. In the related art, for a wavelength in such a wide range, the antireflection function may be insufficient, and a narrow allowable range for a wavelength of an image exposure beam is an issue.

SUMMARY OF THE INVENTION

According to an aspect of the present invention, an electrophotographic apparatus includes an electrophotographic photosensitive member and an image exposure apparatus. The electrophotographic photosensitive member includes a photoconductive layer, a surface layer, and N intermediate layers disposed between the photoconductive layer and the surface layer, N being an odd number more than 2. The image exposure apparatus irradiates a surface of the electrophotographic photosensitive member with an image exposure beam having a central wavelength of $\lambda$ [μm] and forming a latent image on the surface of the electrophotographic photosensitive member. Where $n_0$ is a refractive index of the photoconductive layer, $n_1$ is a refractive index of a first intermediate layer counting from the photoconductive layer side, $n_i$ is a refractive index of an ith intermediate layer counting from the photoconductive layer side, i being an integer equal to or more than 1 and equal to or less than N, $n_N$ is a refractive index of an Nth intermediate layer counting from the photoconductive layer side, $n_{N+1}$ is a refractive index of the surface layer, and $d_i$ is a thickness [μm] of the ith intermediate layer, the refractive indices $n_0$, $n_1$, $n_i$, $n_N$, and $n_{N+1}$ satisfy the following expression (1):

$$n_0 > n_1 > \ldots > n_i > \ldots n_N > n_{N+1} \tag{1}$$

For each of odd-numbered intermediate layers counting from the photoconductive layer side, $n_{i-1}$ being the refractive index $n_0$ of the photoconductive layer when i is 1 and $n_{i+1}$ being the refractive index $n_{N+1}$ of the surface layer when i is N, the refractive index $n_i$ satisfies the following expression (2):

$$\left| \frac{n_i - \sqrt{n_{i-1} \cdot n_{i+1}}}{n_i} \right| \leq 0.02 \tag{2}$$

According to another aspect of the present invention, an electrophotographic photosensitive member includes a photoconductive layer, a surface layer on the photoconductive layer, and N intermediate layers disposed between the photoconductive layer and the surface layer, N being an odd number more than 2. The electrophotographic photosensitive member is an object irradiated with an image exposure beam having a central wavelength of $\lambda$ [μm]. Where $n_0$ is a refractive index of the photoconductive layer, $n_1$ is a refractive index of a first intermediate layer counting from the photoconductive layer side, $n_i$ is a refractive index of an ith intermediate layer counting from the photoconductive layer side, i being an integer equal to or more than 1 and equal to or less than N, $n_N$ is a refractive index of an Nth intermediate layer counting from the photoconductive layer side, $n_{N+1}$ is a refractive index of the surface layer, and $d_i$ is a thickness [μm] of the ith intermediate layer counting from the photoconductive layer side, the refractive indices $n_0$, $n_1$, $n_i$, $n_N$, and $n_{N+1}$ satisfy the following expression (1):

$$n_0 > n_1 > \ldots > n_i > \ldots > n_N > n_{N+1} \quad (1)$$

For each of odd-numbered intermediate layers counting from the photoconductive layer side, $n_{i-1}$ being the refractive index $n_0$ of the photoconductive layer when i is 1 and $n_{i+1}$ being the refractive index $n_{N+1}$ of the surface layer when i is N, the refractive index $n_i$ satisfies the following expression (2):

$$\left| \frac{n_i - \sqrt{n_{i-1} \cdot n_{i+1}}}{n_i} \right| \leq 0.02 \quad (2)$$

For each of the odd-numbered intermediate layers counting from the photoconductive layer side, there exists $p_i$ for enabling the refractive index $n_i$ and the thickness $d_i$ [μm], $p_i$ being a positive integer, to satisfy the following expression (3):

$$\left| \frac{4\pi \cdot n_i \cdot d_i}{\lambda} - (2 \cdot p_i - 1)\pi \right| \leq \frac{\pi}{16} \quad (3)$$

Among combinations in which two intermediate layers are selected from the odd-numbered layers counting from the photoconductive layer side, there exists at least one combination at which q for enabling the sum of the products ($n_i \cdot d_i$) of the refractive indices $n_i$ and the thicknesses $d_i$ [μm] of one or more intermediate layers disposed between selected two intermediate layers, q being an integer equal to or more than 0, to satisfy the following expression (4):

$$\left| \frac{4\pi \cdot \sum n_i \cdot d_i}{\lambda} - 2\pi \cdot q \right| < \frac{\pi}{2} \quad (4)$$

Further features of the present invention will become apparent from the following description of exemplary embodiments with reference to the attached drawings.

BRIEF DESCRIPTION OF THE DRAWINGS

FIGS. 1A-1 to 1C-1 are cross-sectional views each illustrating a configuration that includes three intermediate layers according to an embodiment of the present invention, and FIGS. 1A-2 to 1C-4 are complex plane diagrams illustrating phases of reflected beams occurring at interfaces when an electrophotographic photosensitive member having the above configuration is exposed.

FIGS. 2A-1 to 2H-1 are cross-sectional views each illustrating a configuration that includes five intermediate layers according to an embodiment of the present invention, and FIGS. 2A-2 to 2H-2 are complex plane diagrams illustrating phases of reflected beams occurring at interfaces when an electrophotographic photosensitive member having the above configuration is exposed.

FIGS. 3A-1 to 3I-1 are cross-sectional views each illustrating a configuration that includes seven intermediate layers according to an embodiment of the present invention, and FIGS. 3A-2 to 3I-2 are complex plane diagrams illustrating phases of reflected beams occurring at interfaces when an electrophotographic photosensitive member having the above configuration is exposed.

FIGS. 7A-1 to 7C-1 are cross-sectional views each illustrating a configuration that includes intermediate layers according to a traditional technique, and FIGS. 7A-2 to 7C-4 are complex plane diagrams illustrating phases of reflected beams occurring at interfaces when an electrophotographic photosensitive member having the above configuration is exposed.

DESCRIPTION OF THE EMBODIMENTS

Figures 1, 1A, 1B, 2, 3, 4:
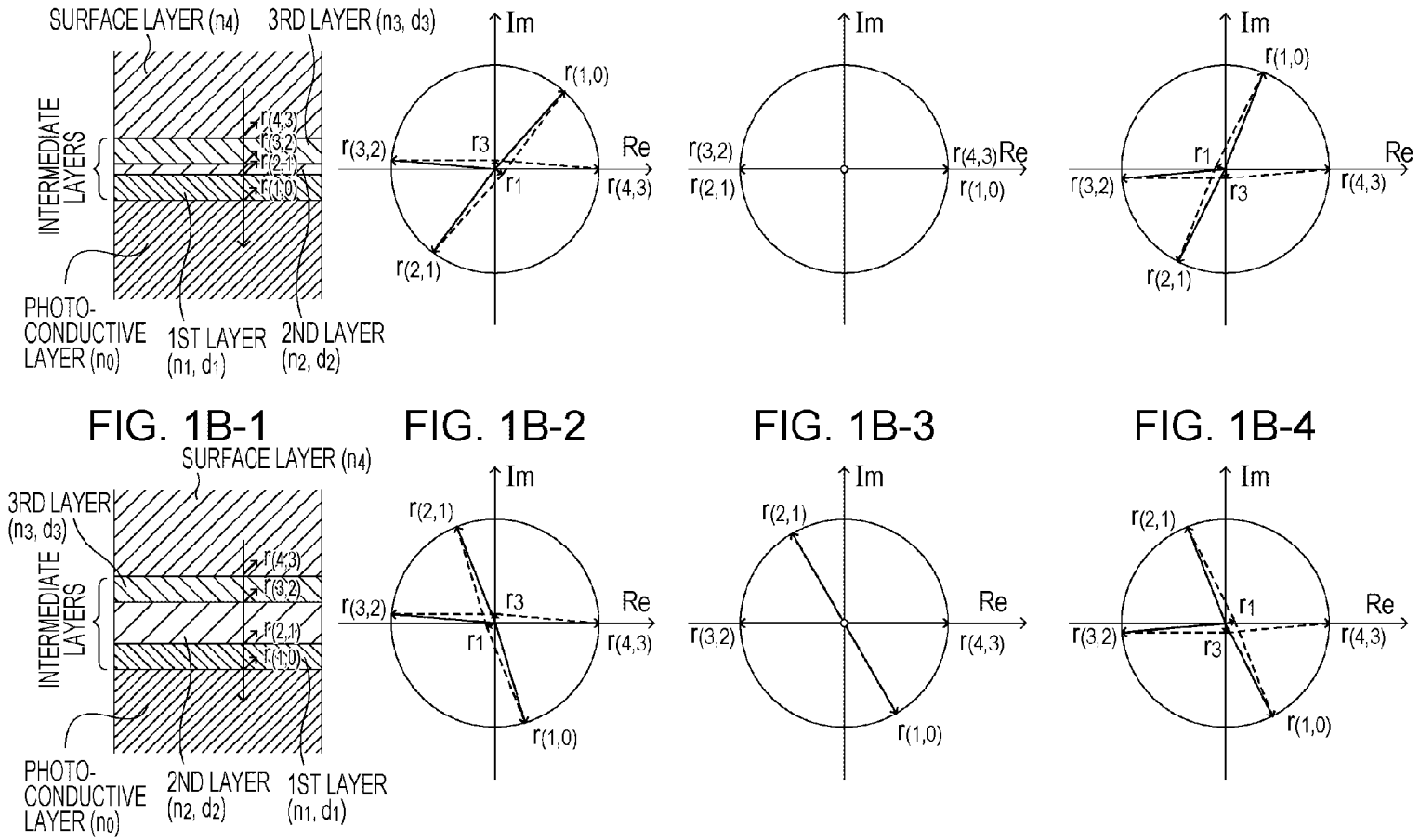

With exemplary embodiments of the present invention, an electrophotographic apparatus that has a wide allowable range for a wavelength of an image exposure beam can be provided. An electrophotographic photosensitive member for use in that electrophotographic apparatus can also be provided.

A semiconductor laser frequently used as a light source for an image exposure beam in an actual electrophotographic apparatus often has an individual difference of approximately ±10 nm to ±20 nm to a central oscillation wavelength. However, in a mass production of electrophotographic apparatuses, formation of an electrophotographic photosensitive member suited for each semiconductor having such an individual difference is virtually impossible. Even if such an individual difference exists in a semiconductor laser, the use of an electrophotographic photosensitive member that has a wide allowable range for a wavelength of an image exposure beam according to exemplary embodiments of the present invention enables easy volume production of electrophotographic apparatuses with a less sensitivity variation.

An electrophotographic photosensitive member according to an embodiment of the present invention includes a photoconductive layer, a surface layer on the photoconductive layer, and intermediate layers disposed between the photoconductive layer and the surface layer. For the embodiment of the present invention, as expressed in the following expression (1), the refractive index of each of the photoconductive layer, the intermediate layers, and the surface layer monotonically decreases from the photoconductive layer toward the surface layer. The refractive index of the photoconductive layer is expressed as $n_0$. The refractive index of the first intermediate layer counting from the photoconductive layer side is expressed as $n_1$. The refractive index of the ith intermediate layer counting from the photoconductive layer side is expressed as $n_i$, i being an integer equal to or more than 1 and equal to or less than N. The refractive index of the Nth intermediate layer counting from the photoconductive layer side is expressed as $n_N$. The refractive index of the surface layer is expressed as $n_{N+1}$. This definition applies to the following description.

$$n_0 > n_1 > \ldots > n_i > \ldots > n_N > n_{N+1} \quad (1)$$

The closer the refractive index of the surface layer to that of the air, the smaller reflection at the interface between the surface layer and the air (at the surface of the electrophotographic photosensitive member). It is useful that the difference between the refractive index $n_{N+1}$ of the surface layer and the refractive index $n_i$ of an intermediate layer and the difference between the refractive index $n_i$ and the refractive index $n_0$ of the photoconductive layer be smaller because the smaller the differences, the less reflectance at each interface. For the configuration in which the refractive index monotonically decreases from the photoconductive layer toward the surface layer, because an incident beam on the surface layer travels from a low-refractive-index layer to a high-refractive-index layer, the phase of a reflected beam at an interface between the layers is shifted by π with respect to the incident beam.

For the embodiment of the present invention, the number of intermediate layers, N, is an odd number more than 2. This aims to provide an odd-numbered intermediate layer counting from the photoconductive layer side (hereinafter also referred to as "odd-numbered layer") and an even-numbered intermediate layer counting from the photoconductive layer side (hereinafter also referred to as "even-numbered layer") with different roles to perform the antireflective function as a whole.

Adjustment of the refractive index of each odd-numbered layer so as to satisfy the following expression (2) enables the two interfaces adjacent to the odd-numbered layer to have substantially the same value of amplitude reflectance.

$$\left| \frac{n_i - \sqrt{n_{i-1} \cdot n_{i+1}}}{n_i} \right| \leq 0.02 \quad (2)$$

Under the conditions where the refractive index of each of the surface layer, the intermediate layers, and the photoconductive layer satisfies the above expression (1), adjusting the refractive index and the thickness of each odd-numbered layer such that there exists $p_i$ for enabling the refractive index and the thickness of the odd-numbered layer, $p_i$ being a positive integer, to satisfy the following expression (3) allows a phase difference between beams reflected at the two interfaces adjacent to the odd-numbered layer to be approximately π. The thickness of the ith intermediate layer counting from the photoconductive layer side is expressed as $d_i$ [μm]. This definition applies to the following description.

$$\left| \frac{4\pi \cdot n_i \cdot d_i}{\lambda} - (2 \cdot p_i - 1)\pi \right| \leq \frac{\pi}{16} \quad (3)$$

As a result, reflected beams at two interfaces adjacent to an odd-numbered layer cancel each other out. This effect is maximum when the surface of an electrophotographic photosensitive member, which is an object irradiated with a beam, is irradiated with a beam having the wavelength λ. However, it decreases with a beam of a wavelength other than λ [μm].

To address this, for the embodiment of the present invention, the function of reducing, using an even-numbered layer, remaining resultant reflection vectors that are not cancelled by each odd-numbered layer in a wavelength range other than λ [μm] is provided. That is, the refractive indices and thicknesses of the odd-numbered layers and even-numbered layers are adjusted such that, among combinations in which two intermediate layers are selected from the odd-numbered layers, there exists at least one combination at which q for enabling the sum of the products ($n_i \cdot d_i$) of the refractive indices $n_i$ and the thicknesses $d_i$ [μm] of one or more intermediate layers disposed between selected two odd-numbered layers, q being an integer equal to or more than 0, to satisfy the following expression (4). As a result, each of the two remaining resultant reflection vectors that are not cancelled by the two odd-numbered layers has a phase more than π/2 and less than 3π/2, and the phases weaken each other. Accordingly, the antireflective function is obtainable in a wide wavelength range whose center is λ [μm].

$$\left| \frac{4\pi \cdot \sum n_i \cdot d_i}{\lambda} - 2\pi \cdot q \right| < \frac{\pi}{2} \quad (4)$$

In the embodiment of the present invention, an image exposure beam having a central wavelength λ [μm] indicates an image exposure beam that has a central oscillation wavelength of λ [μm] under approximately 25° C. environment and that is emitted from a light source for an image exposure beam (e.g., semiconductor laser).

An example configuration that includes three intermediate layers is specifically described with reference to FIGS. 1 and 7. Note that FIGS. 1 and 7 are not necessarily drawn to scale, and the same applies to the other figures.

FIGS. 1A-1, 1B-1, and 1C-1 are cross-sectional views of a configuration that includes three intermediate layers according to an embodiment of the present invention. FIGS. 1A-2, 1B-2, and 1C-2 are complex plane diagrams that illustrate phases of reflected beams occurring at the interfaces illustrated in FIGS. 1A-1, 1B-1, and 1C-1 when a beam having a wavelength λ+Δλ, which is longer than the wavelength λ, is incident on the interfaces from the surface layer side. A reflected beam at the interface between a layer with the refractive index $n_i$ (the ith intermediate layer counting from the photoconductive layer side) and a layer with the refractive index $n_{i-1}$ (the (i−1)th intermediate layer counting from the photoconductive layer side) is expressed as $r_{(i,\ i+1)}$, and the phase of a reflected beam $r_{(4,\ 3)}$ is 0. Similarly, FIGS. 1A-3, 1B-3, and 1C-3 are complex plane diagrams that illustrate phases of reflected beams occurring at the interfaces when a beam having the wavelength λ is incident on the interfaces. FIGS. 1A-4, 1B-4, and 1C-4 are complex plane diagrams that illustrate phases of reflected beams occurring at the interfaces when a beam having a wavelength λ−Δλ, which is shorter than the wavelength λ, is incident on the interfaces.

For the configuration including three intermediate layers, there are four interfaces in a section between the surface layer and the photoconductive layer (this section is also referred to as "interlayer section"). Therefore, it is useful to establish a relationship in which four reflected beams at the four interfaces weaken each other. For example, in terms of a resultant reflection vector in which two reflected beams at two interfaces adjacent to each odd-numbered layer are combined, four reflected beams are consolidated into two resultant reflection vectors. Accordingly, in the case of the configuration including three intermediate layers, it is useful that two resultant reflection vectors weaken each other, i.e., the phase difference between the two resultant reflection vectors be more than $\pi/2$ and less than $3\pi/2$. In particular, the closer the phase difference between the two resultant reflection vectors to it, the larger that advantageous effect.

For the example illustrated in FIG. 1, the refractive index of each layer satisfies the above expression (1) and monotonically decreases from the photoconductive layer toward the surface layer. The refractive index of each of the first and third intermediate layers, which are odd-numbered layers, satisfies the above expression (2). The optimum value of the refractive index of an odd-numbered layer is the geometrical mean of the refractive indices of the two even-numbered layers adjacent to the odd-numbered layer. In the example illustrated in FIG. 1, the refractive index of each of all the odd-numbered layers is the geometrical mean of the two even-numbered layers adjacent thereto. If the central wavelength of an image exposure beam used in forming a latent image is 2, the product of the refractive index and the thickness of each of the first and third intermediate layers, which are odd-numbered layers, meets the condition of the above expression (3). The optimum value of the product of the refractive index and the thickness of an odd-numbered layer is an odd multiple of $\lambda/4$; in the example illustrated in FIG. 1, the product of the refractive index and the thickness of each of all the odd-numbered layers is $\lambda/4$.

In the case of the configuration including three intermediate layers, the odd-numbered layers are the first and third intermediate layers, and only the second intermediate layer is disposed between the odd-numbered layers. Accordingly, for the embodiment of the present invention, the product of the refractive index and the thickness of the second intermediate layer meets the condition of the above expression (4).

FIG. 1A-1 illustrates an example in which the product of the refractive index and the thickness of the second intermediate layer is $\lambda/12$ and the condition of the above expression (4) is met.

FIG. 1B-1 illustrates an example in which the product of the refractive index and the thickness of the second intermediate layer is $5\lambda/12$ and the condition of the above expression (4) is met.

Figures 1, 1C:
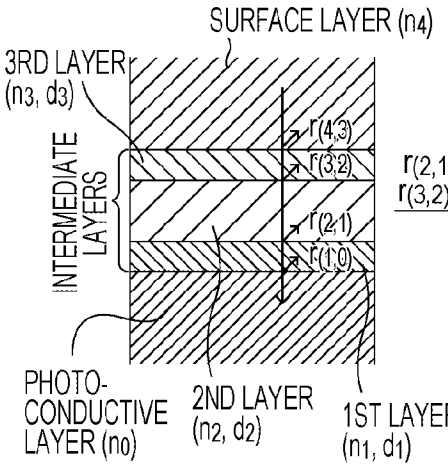
Figures 1, 1C, 2:
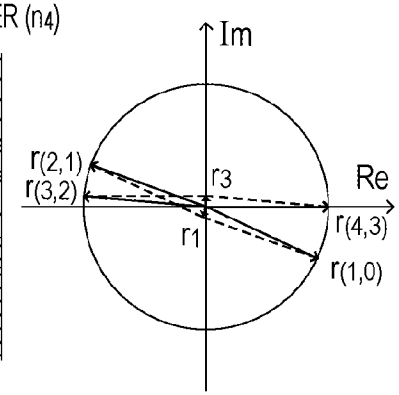
Figures 1, 1C, 2, 3:
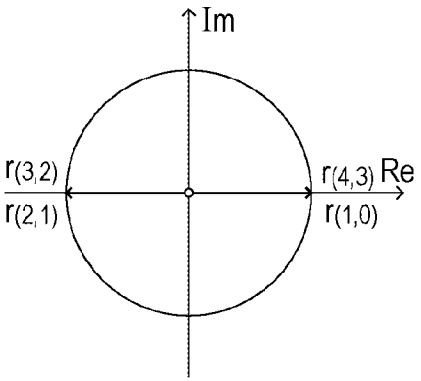
Figures 1, 1C, 2, 3, 4:
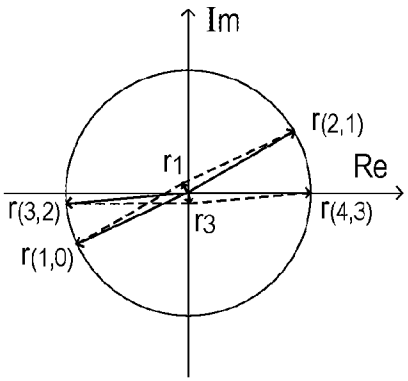

FIG. 1C-1 illustrates an example in which the product of the refractive index and the thickness of the second intermediate layer is $\lambda/2$ and the condition of the above expression (4) is met.

For the examples illustrated in FIGS. 1A-1, 1B-1, and 1C-1, when the beam with the wavelength $\lambda$ is incident, the phase difference between the reflected beam $r_{(4,3)}$ and the reflected beam $r_{(3,2)}$ is $\pi$, and the reflected beam $r_{(4,3)}$, and the reflected beam $r_{(3,2)}$ cancel each other out, as illustrated in FIGS. 1A-3, 1B-3, and 1C-3. Similarly, the phase difference between the reflected beam $r_{(2,1)}$ and the reflected beam $r_{(1,0)}$ is $\pi$, and the reflected beam $r_{(2,1)}$ and the reflected beam $r_{(1,0)}$ cancel each other out. Accordingly, a reflected beam of all the intermediate layers is 0.

However, as illustrated in FIGS. 1A-2, 1B-2, and 1C-2, when the beam with the wavelength $\lambda+\Delta\lambda$, which is longer than the wavelength $\lambda$, is incident, the phase difference between the reflected beam $r_{(4,3)}$ and the reflected beam $r_{(3,2)}$ is $\pi-\pi\Delta\lambda/\lambda$. Accordingly, the reflected beam $r_{(4,3)}$ and the reflected beam $r_{(3,2)}$ do not completely cancel each other out, and a resultant reflection vector $r_3$ remains. Similarly, the phase difference between the reflected beam $r_{(2,3)}$ and the reflected beam $r_{(1,0)}$ is $\pi-\pi\Delta\lambda/\lambda$, the reflected beam $r_{(2,1)}$ and the reflected beam $r_{(1,0)}$ do not completely cancel each other out, and a resultant reflection vector $r_i$ remains.

As illustrated in FIGS. 1A-4, 1B-4, and 1C-4, also when the beam with the wavelength $\lambda-\Delta\lambda$, which is shorter than the wavelength $\lambda$, is incident, for the same reason, resultant reflection vectors $r_1$ and $r_3$ remain.

Examples in which the second intermediate layer meets the condition of the above expression (4) are illustrated in FIGS. 1A-2, 1B-2, 1C-2, 1A-4, 1B-4, and 1C-4. For these examples, as illustrated in the drawings, at a wavelength other than the wavelength $\lambda$, the phase difference between the resultant reflection vector $r_1$ remaining because having not been completely cancelled by the first intermediate layer and the resultant reflection vector $r_3$ remaining because having not been completely cancelled by the third intermediate layer is more than $\pi/2$ and less than $3\pi/2$. Accordingly, the resultant reflection vectors $r_1$ and $r_3$ weaken each other. Therefore, the antireflective function is obtainable in a wide wavelength range whose center is the wavelength $\lambda$. In particular, for the example illustrated in FIG. 1C-1, the product of the refractive index and the thickness of the second intermediate layer is $\lambda/2$. The example illustrated in FIG. 1C-1 also meets the condition of the following expression (5). When the product of the refractive index and the thickness of the second intermediate layer is $\lambda/2$, because the phase difference between the resultant reflection vectors $r_1$ and $r_3$ is approximately $\pi$, the resultant reflection vectors $r_1$ and $r_3$ effectively weaken each other.

Figures 1, 7A:
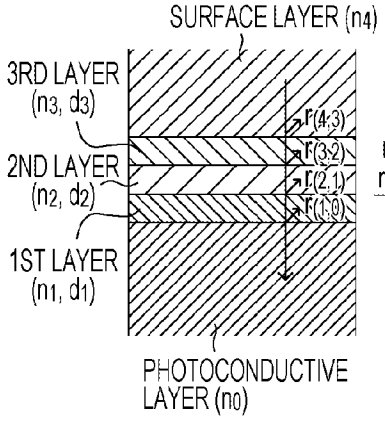
Figures 2, 7A:
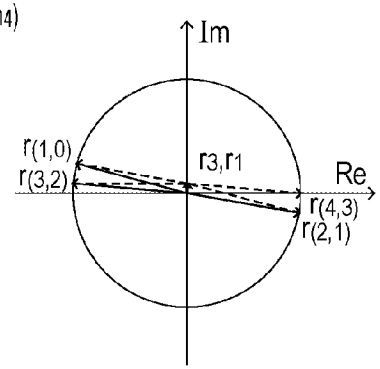
Figures 3, 7A:
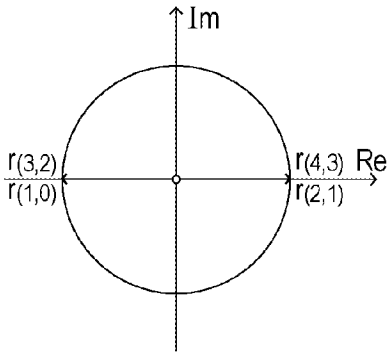
Figures 4, 7A:
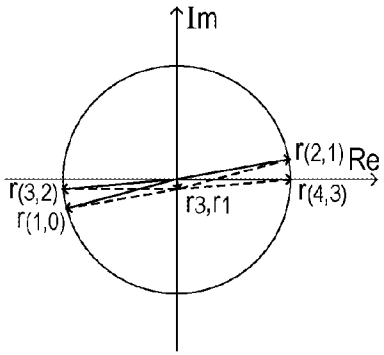

FIG. 7A-1 is a cross-sectional view that illustrates a configuration including three intermediate layers according to a traditional technique.

FIG. 7A-1 illustrates an example in which the product of the refractive index and the thickness of each of all the intermediate layers is $\lambda/4$ and the condition of the above expression (4) is not met. In this case, as illustrated in FIGS. 7A-2 and 7A-4, at a wavelength other than the wavelength $\lambda$, the phase difference between the resultant reflection vectors $r_1$ and $r_3$ is more than $-\pi/2$ and less than $\pi/2$. Accordingly, the resultant reflection vectors $r_1$ and $r_3$ strengthen each other. Particularly, in the example illustrated in FIG. 7A-1, because the product of the refractive index and the thickness of the second intermediate layer is $\lambda/4$, the phase difference between the resultant reflection vectors $r_1$ and $r_3$ is approximately 0, and the resultant reflection vectors $r_1$ and $r_3$ most strengthen each other.

Next, an example configuration that includes five intermediate layers is specifically described with reference to FIGS. 2 and 7.

FIGS. 2A-1, 2B-1, 2C-1, 2D-1, 2E-1, 2F-1, 2G-1, and 2H-1 are cross-sectional views of a configuration that includes five intermediate layers according to an embodiment of the present invention. FIGS. 2A-2, 2B-2, 2C-2, 2D-2, 2E-2, 2F-2, 2G-2, and 2H-2 are complex plane diagrams that illustrate phases of reflected beams occurring at the interfaces illustrated in FIGS. 2A-1, 2B-1, 2C-1, 2D-1, 2E-1, 2F-1, 2G-1, and 2H-1 when a beam having a wavelength $\lambda+\Delta\lambda$, which is longer than the wavelength $\lambda$, is incident on the interfaces from the surface layer side. The phase of a reflected beam $r_{(6,5)}$ is 0.

For the configuration including five intermediate layers, there are six interfaces in the interlayer section. Therefore, it is useful to establish a relationship in which six reflected beams at the six interfaces weaken each other. For example, in terms of a resultant reflection vector in which two reflected beams at two interfaces adjacent to each odd-numbered layer are combined, six reflected beams are consolidated into three resultant reflection vectors. Accordingly, if the phase difference between at least two resultant reflection vectors of the three resultant reflection vectors is more than $\pi/2$ and less than $3\pi/2$, because the at least two resultant reflection vectors weaken each other, the advantageous effects according to exemplary embodiments of the present invention are obtainable. In particular, the closer the phase difference between the two resultant reflection vectors to $\pi$, the larger that advantageous effect. Alternatively, also if the three resultant reflection vectors are arranged at substantially equal phase intervals, because the three vectors weaken each other, the advantageous effects according to exemplary embodiments of the present invention are obtainable.

For the example illustrated in FIG. 2, as in the case of the configuration including three intermediate layers, the refractive index of each odd-numbered layer is the geometrical mean of the refractive indices of the two even-numbered layers adjacent to the odd-numbered layer, and the product of the refractive index and the thickness is $\lambda/4$.

Figures 1, 2A:
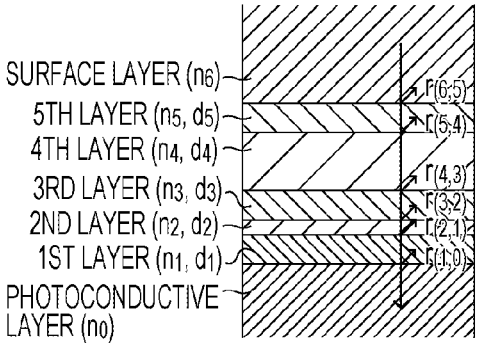
Figures 2, 2A:
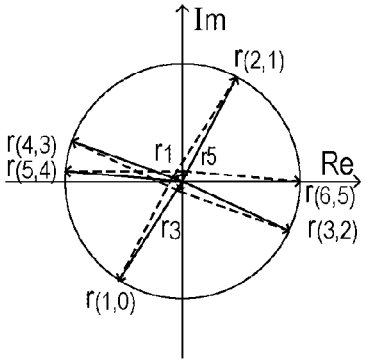

FIG. 2A-1 illustrates an example in which the product of the refractive index and the thickness of the second intermediate layer is $\lambda/8$ and the product of the refractive index and the thickness of the fourth intermediate layer is $\lambda/2$, and the fourth intermediate layer meets the condition of the above expression (4). For the example of FIG. 2A-1, the phase difference between the resultant reflection vectors $r_3$ and $r_5$ is approximately $\pi$ and the resultant reflection vectors $r_3$ and $r_5$ weaken each other, as illustrated in FIG. 2A-2, so the advantageous effects according to exemplary embodiments of the present invention are obtainable.

Figures 1, 2B:
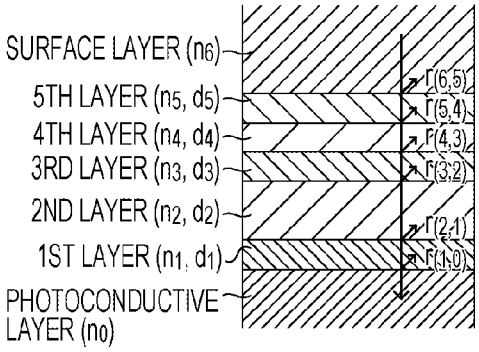
Figures 2, 2B:
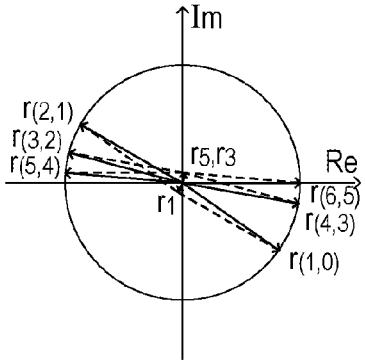

FIG. 2B-1 illustrates an example in which the product of the refractive index and the thickness of the second intermediate layer is $\lambda/2$ and the product of the refractive index and the thickness of the fourth intermediate layer is $\lambda/4$, and the second intermediate layer meets the condition of the above expression (4). For the example of FIG. 2B-1, the phase difference between the resultant reflection vector $r_1$ and each of the resultant reflection vectors $r_3$ and $r_5$ is approximately $\pi$ and the resultant reflection vector $r_1$ and the resultant reflection vector $r_5$ weaken each other, as illustrated in FIG. 2B-2, so the advantageous effects according to exemplary embodiments of the present invention are obtainable.

Figures 1, 2C:
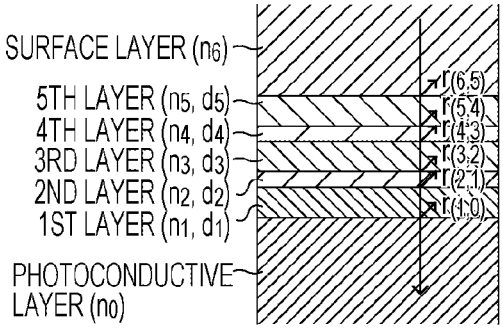
Figures 2, 2C:
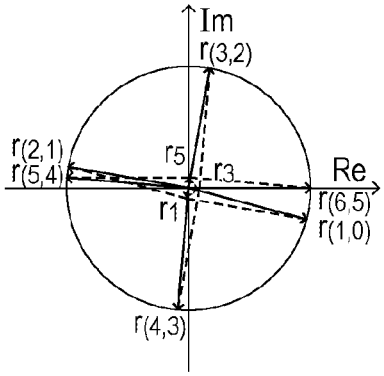

FIG. 2C-1 illustrates an example in which the product of the refractive index and the thickness of the second intermediate layer is $\lambda/8$, the product of the refractive index and the thickness of the third intermediate layer is $\lambda/4$, and the product of the refractive index and the thickness of the fourth intermediate layer is $\lambda/8$. Accordingly, the sum of the products of the refractive indices and the thicknesses of the second to fourth intermediate layers is $\lambda/2$, and the condition of the above expression (4) is met. For the example of FIG. 2C-1, the phase difference between the resultant reflection vector $r_1$ and each of the resultant reflection vectors $r_1$ and $r_5$ is approximately $\pi$ and the resultant reflection vectors $r_1$ and $r_5$ weaken each other, as illustrated in FIG. 2C-2, so the advantageous effects according to exemplary embodiments of the present invention are obtainable.

Figures 1, 2D:
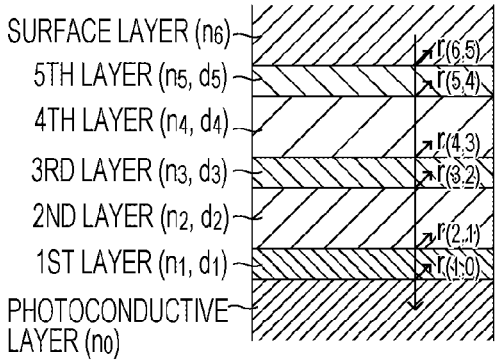
Figures 2, 2D:
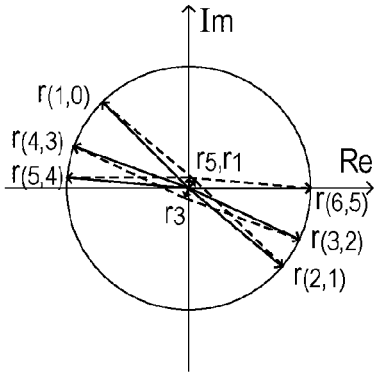

FIG. 2D-1 illustrates an example in which the product of the refractive index and the thickness of the second intermediate layer is $\lambda/2$, the product of the refractive index and the thickness of the fourth intermediate layer is $\lambda/2$, and the second and fourth intermediate layers meet the condition of the above expression (4). For the example of FIG. 2D-1, the phase difference between the resultant reflection vector $r_3$ and each of the resultant reflection vectors $r_1$ and $r_5$ is approximately $\pi$ and the resultant reflection vector $r_3$ and each of the resultant reflection vectors $r_1$ and $r_5$ weaken each other, as illustrated in FIG. 2D-2, so the advantageous effects according to exemplary embodiments of the present invention are obtainable.

Figures 1, 2E:
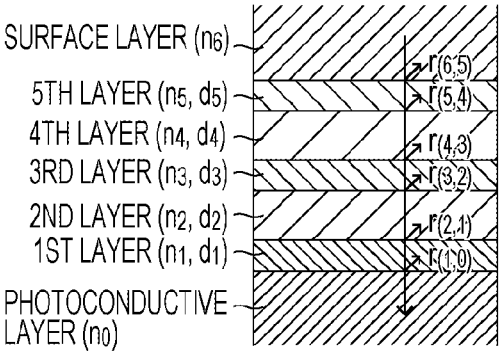
Figures 2, 2E:
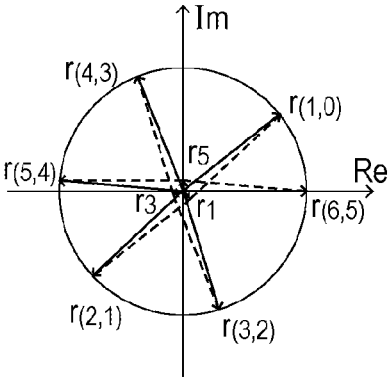

FIG. 2E-1 illustrates an example in which the product of the refractive index and the thickness of the second intermediate layer is $5\lambda/12$, the product of the refractive index and the thickness of the fourth intermediate layer is $5\lambda/12$, and the second and fourth intermediate layers meet the condition of the above expression (4). In the example of FIG. 2E-1, the conditions of expressions (8) and (9), which are described below, are also met. For the example of FIG. 2E-1, the phase difference between each of the three resultant reflection vectors $r_1$, $r_3$, and $r_5$ and its adjacent resultant reflection vector is approximately $2\pi/3$, as illustrated in FIG. 2E-2. That is, the resultant reflection vectors $r_1$, $r_3$, and $r_5$ are arranged at substantially equal phase intervals, and these three resultant reflection vectors weaken each other. Therefore, the advantageous effects according to exemplary embodiments of the present invention are obtainable.

Figures 1, 2F:
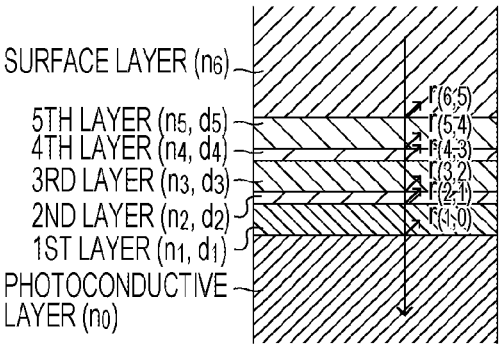
Figures 2, 2F:
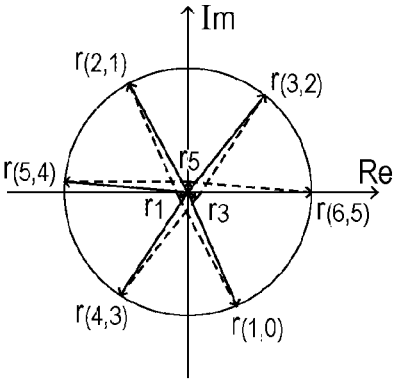

FIG. 2F-1 illustrates an example in which the product of the refractive index and the thickness of the second intermediate layer is $\lambda/12$, the product of the refractive index and the thickness of the fourth intermediate layer is $\lambda/12$, and the second and fourth intermediate layers meet the condition of the above expression (4). In the example of FIG. 2F-1, the conditions of the expressions (8) and (9), which are described below, are also met. For the example of FIG. 2F-1, the phase difference between each of the three resultant reflection vectors $r_1$, $r_3$, and $r_5$ and its adjacent resultant reflection vector is approximately $2\pi/3$, as illustrated in FIG. 2F-2. That is, the resultant reflection vectors $r_1$, $r_3$, and $r_5$ are arranged at substantially equal phase intervals, and these three resultant reflection vectors weaken each other. Therefore, the advantageous effects according to exemplary embodiments of the present invention are obtainable.

Figures 1, 2G:
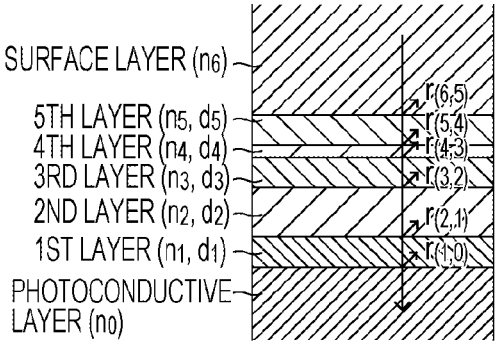
Figures 2, 2G:
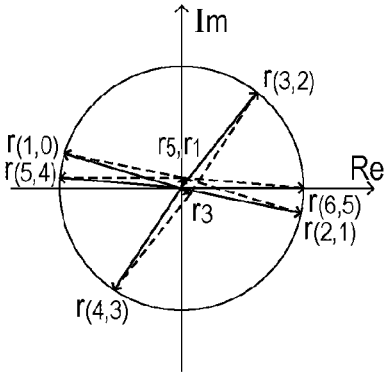

FIG. 2G-1 illustrates an example in which the product of the refractive index and the thickness of the second intermediate layer is $5\lambda/12$, the product of the refractive index and the thickness of the fourth intermediate layer is $\lambda/12$, and the second and fourth intermediate layers meet the condition of the above expression (4). In the example of FIG. 2G-1, the condition of the expression (8), which is described below, is also met. For the example of FIG. 2G-1, the resultant reflection vector $r_3$ and each of the resultant reflection vectors $r_1$ and $r_5$ weaken each other, as illustrated in FIG. 2G-2, so the advantageous effects according to exemplary embodiments of the present invention are obtainable.

Figures 1, 2H:
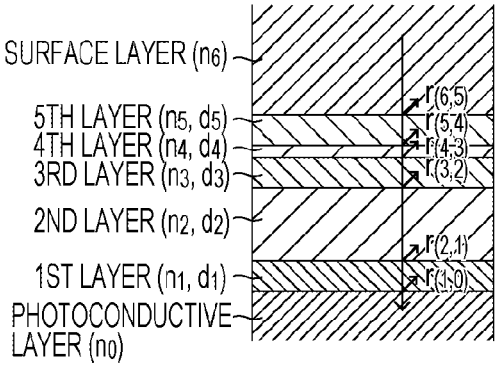
Figures 2, 2H:
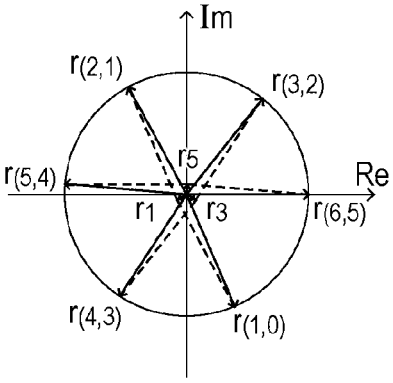

FIG. 2H-1 illustrates an example in which the product of the refractive index and the thickness of the second intermediate layer is $7\lambda/12$, the product of the refractive index and the thickness of the fourth intermediate layer is $\lambda/12$, and the second and fourth intermediate layers meet the condition of the above expression (4). In the example of FIG. 2H-1, the conditions of the expressions (8) and (9), which are described below, are also met. For the example of FIG. 2H-1, the phase difference between each of the three resultant reflection vectors $r_1$, $r_3$ and $r_5$ and its adjacent resultant reflection vector is approximately $2\pi/3$, as illustrated in FIG. 2H-2. That is, the resultant reflection vectors $r_1$, $r_3$, and $r_5$ are arranged at substantially equal phase intervals, and these three resultant reflection vectors weaken each other. Therefore, the advantageous effects according to exemplary embodiments of the present invention are obtainable.

Figures 1, 7B:
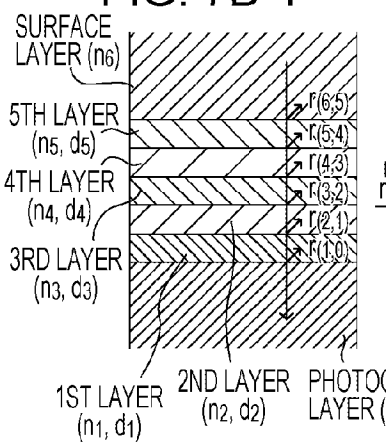
Figures 2, 7B:
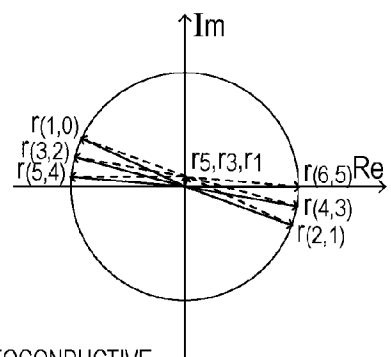
Figures 3, 7B:
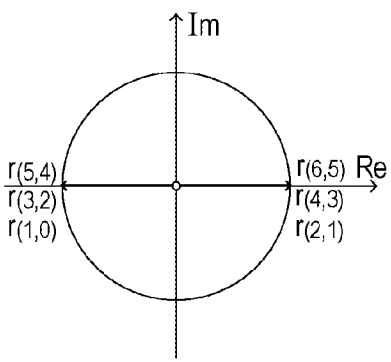
Figures 4, 7B:
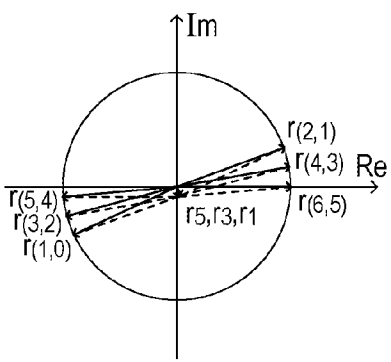
Figures 1, 7C:
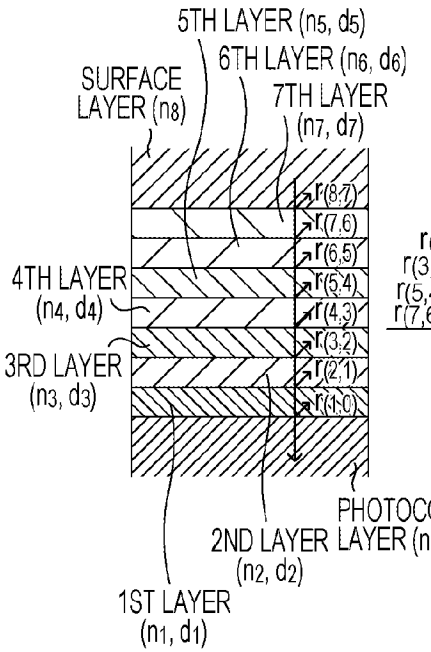
Figures 2, 7C:
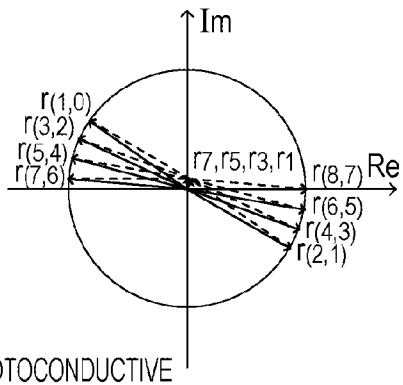
Figures 3, 7C:
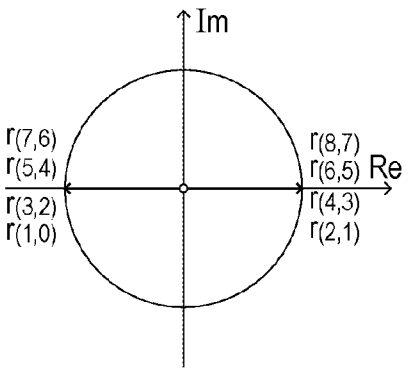
Figures 4, 7C:
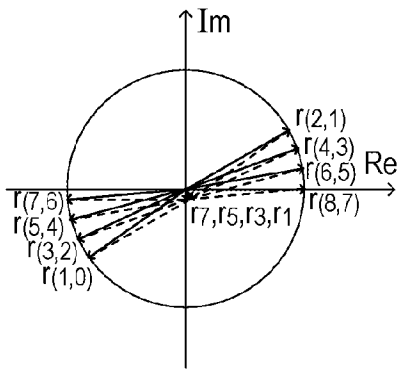

FIG. 7B-1 is a cross-sectional view that illustrates a configuration including five intermediate layers according to a traditional technique.

FIG. 7B-1 illustrates an example in which the product of the refractive index and the thickness of each of all the intermediate layers is $\lambda/4$ and the condition of the above expression (4) is not met. In this case, as illustrated in FIGS. 7B-2 and 7B-4, at a wavelength other than the wavelength $\lambda$, the phase difference between each of the three resultant reflection vectors $r_1$, $r_3$ and $r_5$ and its adjacent resultant reflection vector is more than $-\pi/2$ and less than $\pi/2$, so these three resultant reflection vectors strengthen each other. In particular, in the example illustrated in FIG. 7B-1, because the product of the refractive index and the thickness of each even-numbered layer is $\lambda/4$, the phase differences among the resultant reflection vectors $r_1$, $r_3$, and $r_5$ are approximately 0, and the resultant reflection vectors $r_1$, $r_3$, and $r_5$ most strengthen each other.

Next, an example configuration that includes seven intermediate layers is specifically described with reference to FIG. 3.

FIGS. 3A-1, 3B-1, 3C-1, 3D-1, 3E-1, 3F-1, 3G-1, 3H-1, 3I-1 are cross-sectional views of a configuration that includes seven intermediate layers according to an embodiment of the present invention. FIGS. 3A-2, 3B-2, 3C-2, 3D-2, 3E-2, 3F-2, 3G-2, 3H-2, and 3I-2 are complex plane diagrams that illustrate phases of reflected beams occurring at the interfaces illustrated in FIGS. 3A-1, 3B-1, 3C-1, 3D-1, 3E-1, 3F-1, 3G-1, 3H-1, and 3I-1 when a beam having a wavelength $\lambda+\Delta\lambda$, which is longer than the wavelength $\lambda$, is incident on the interfaces from the surface layer side. The phase of a reflected beam $r_{(8,7)}$, is 0.

For the configuration including seven intermediate layers, there are eight interfaces in the interlayer section. Therefore, it is useful to establish a relationship in which eight reflected beams at the eight interfaces weaken each other. For example, in terms of a resultant reflection vector in which two reflected beams at two interfaces adjacent to each odd-numbered layer are combined, eight reflected beams are consolidated into four resultant reflection vectors. Accordingly, in the case of the configuration including seven intermediate layers, if four resultant reflection vectors weaken each other, i.e., if the phase difference between at least two resultant reflection vectors of the four resultant reflection vectors is more than $\pi/2$ and less than $3\pi/2$, because the at least two resultant reflection vectors weaken each other, the advantageous effects according to exemplary embodiments of the present invention are obtainable. In particular, the closer the phase difference between the two resultant reflection vectors to $\pi$, the larger that advantageous effect. Alternatively, also if the four resultant reflection vectors are arranged at substantially equal phase intervals, because these four vectors weaken each other, the advantageous effects according to exemplary embodiments of the present invention are obtainable.

For the example illustrated in FIG. 3, as in the case of the configuration including three intermediate layers, the refractive index of each odd-numbered layer is the geometrical mean of the refractive indices of the two even-numbered layers adjacent to the odd-numbered layer, and the product of the refractive index and the thickness is $\lambda/4$.

Figures 1, 3A:
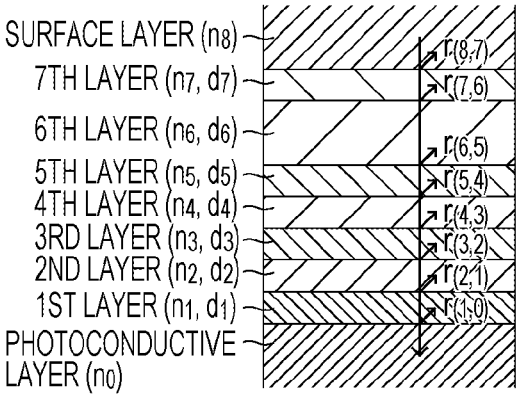
Figures 2, 3A:
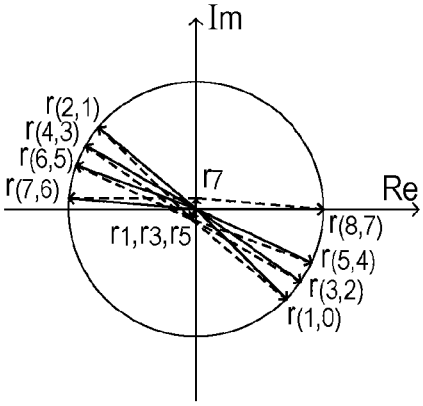

FIG. 3A-1 illustrates an example in which the product of the refractive index and the thickness of the second intermediate layer is $\lambda/4$ and the product of the refractive index and the thickness of the fourth intermediate layer is $\lambda/4$, the product of the refractive index and the thickness of the sixth intermediate layer is $\lambda/2$, and the sixth intermediate layer meets the condition of the above expression (4). For the example of FIG. 3A-1, the phase difference between the resultant reflection vector $r_7$ and each of the resultant reflection vectors $r_1$, $r_3$ and $r_5$ is approximately $\pi$, as illustrated in FIG. 3A-2. Accordingly, the resultant reflection vector $r_7$ and each of the resultant reflection vectors $r_1$, $r_3$, and $r_5$ weaken each other, so the advantageous effects according to exemplary embodiments of the present invention are obtainable.

Figures 1, 3B:
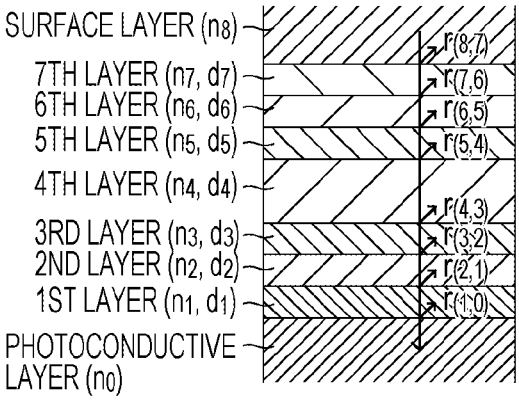
Figures 2, 3B:
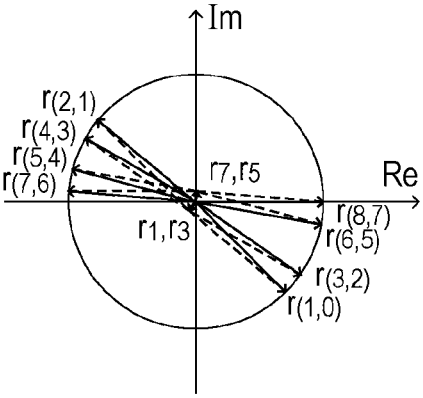

FIG. 3B-1 illustrates an example in which the product of the refractive index and the thickness of the second intermediate layer is $\lambda/4$ and the product of the refractive index and the thickness of the fourth intermediate layer is $\lambda/2$, the product of the refractive index and the thickness of the sixth intermediate layer is $\lambda/4$, and the fourth intermediate layer meets the condition of the above expression (4). For the example of FIG. 3B-1, the phase difference between each of the resultant reflection vectors $r_1$ and $r_3$ and each of the resultant reflection vectors $r_5$ and $r_7$ is approximately $\pi$, as illustrated in FIG. 3B-2, and each of the resultant reflection vectors $r_1$ and $r_3$ and each of the resultant reflection vectors $r_5$ and $r_7$ weaken each other. Therefore, the advantageous effects according to exemplary embodiments of the present invention are obtainable.

Figures 1, 3C:
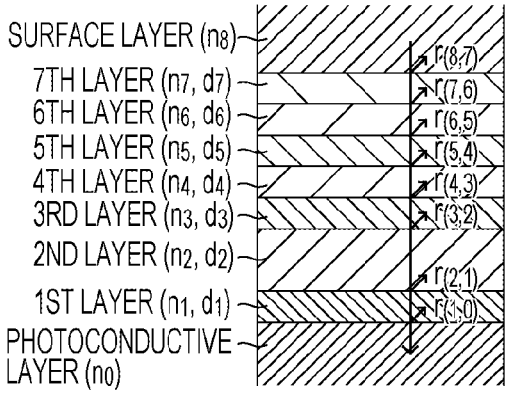
Figures 2, 3C:
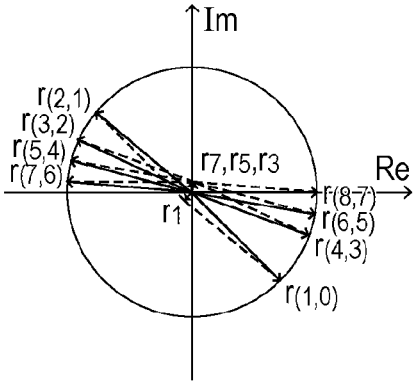

FIG. 3C-1 illustrates an example in which the product of the refractive index and the thickness of the second intermediate layer is $\lambda/2$, the product of the refractive index and the thickness of the fourth intermediate layer is $\lambda/4$, the product of the refractive index and the thickness of the sixth intermediate layer is $\lambda/4$, and the second intermediate layer meets the condition of the above expression (4). For the example of FIG. 3C-1, the phase difference between the resultant reflection vector $r_1$ and each of the resultant reflection vectors $r_3$, $r_5$, and $r_7$ is approximately $\pi$, as illustrated in FIG. 3C-2. Accordingly, the resultant reflection vector $r_1$ and each of the resultant reflection vectors $r_3$, $r_5$, and $r_7$ weaken each other, so the advantageous effects according to exemplary embodiments of the present invention are obtainable.

Figures 1, 3D:
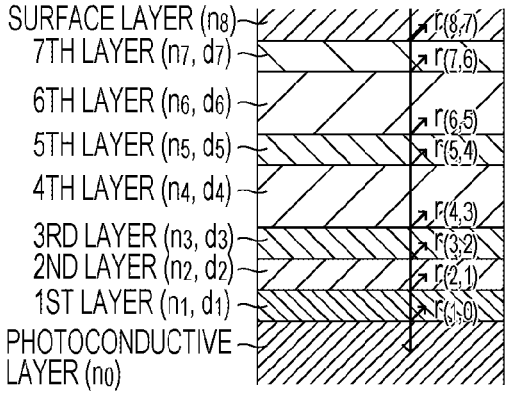
Figures 2, 3D:
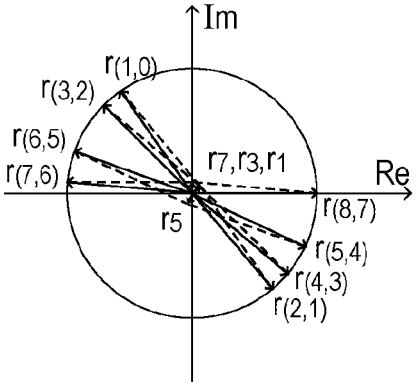

FIG. 3D-1 illustrates an example in which the product of the refractive index and the thickness of the second intermediate layer is $\lambda/4$, the product of the refractive index and the thickness of the fourth intermediate layer is $\lambda/2$, and the product of the refractive index and the thickness of the sixth intermediate layer is $\lambda/2$, and the fourth and sixth intermediate layers meet the condition of the above expression (4). For the example of FIG. 3D-1, the phase difference between the resultant reflection vector $r_5$ and each of the resultant reflection vectors $r_1$, $r_3$ and $r_7$ is approximately $\pi$, as illustrated in FIG. 3D-2. Accordingly, the resultant reflection vector $r_5$ and each of the resultant reflection vectors $r_1$, $r_3$, and $r_7$ weaken each other, so the advantageous effects according to exemplary embodiments of the present invention are obtainable.

Figures 1, 3E:
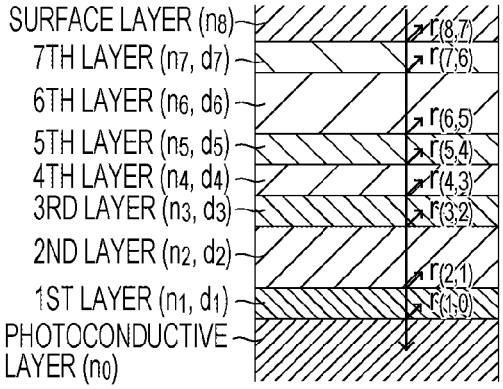
Figures 2, 3E:
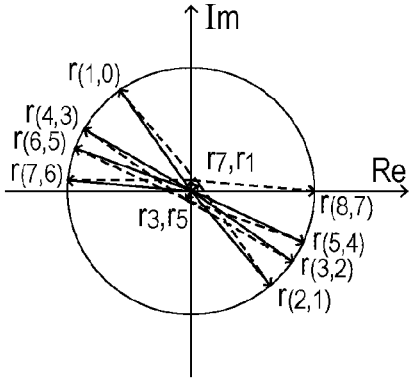

FIG. 3E-1 illustrates an example in which the product of the refractive index and the thickness of the second intermediate layer is $\lambda/2$, the product of the refractive index and the thickness of the fourth intermediate layer is $\lambda/4$, the product of the refractive index and the thickness of the sixth intermediate layer is $\lambda/2$, and the second and sixth intermediate layers meet the condition of the above expression (4). For the example of FIG. 3E-1, the phase difference between each of the resultant reflection vectors $r_1$ and $r_7$ and each of the resultant reflection vectors $r_3$ and $r_5$ is approximately $\pi$, as illustrated in FIG. 3E-2. Accordingly, each of the resultant reflection vectors $r_1$ and $r_7$ and each of the resultant reflection vectors $r_3$ and $r_5$ weaken each other. Therefore, the advantageous effects according to exemplary embodiments of the present invention are obtainable.

Figures 1, 3F:
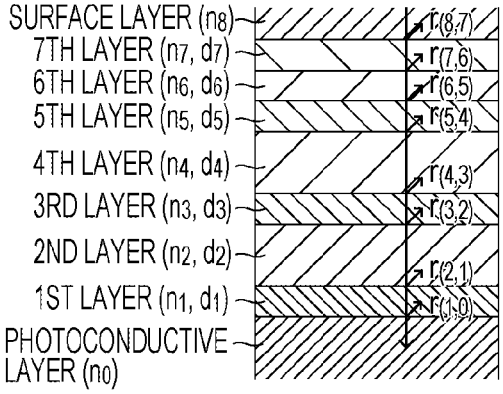
Figures 2, 3F:
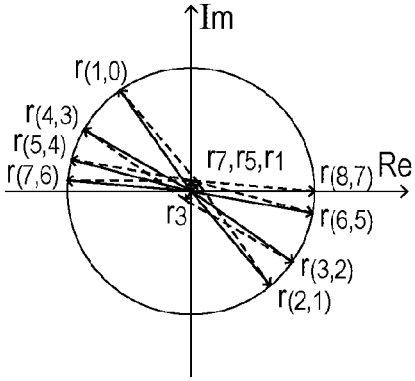

FIG. 3F-1 illustrates an example in which the product of the refractive index and the thickness of the second intermediate layer is $\lambda/2$, the product of the refractive index and the thickness of the fourth intermediate layer is $\lambda/2$, the product of the refractive index and the thickness of the sixth intermediate layer is $\lambda/4$, and the second and fourth intermediate layers meet the condition of the above expression (4). For the example of FIG. 3F-1, the phase difference between the resultant reflection vector and each of the resultant reflection vectors $r_1$, $r_5$, and $r_7$ is approximately $\pi$, as illustrated in FIG. 3F-2. Accordingly, the resultant reflection vector and each of the resultant reflection vectors $r_1$, $r_5$, and $r_7$ weaken each other, so the advantageous effects according to exemplary embodiments of the present invention are obtainable.

Figures 1, 3G:
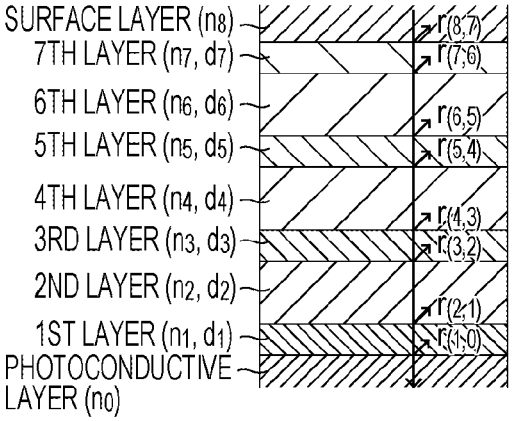
Figures 2, 3G:
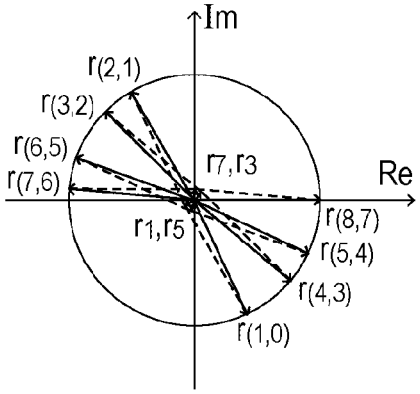

FIG. 3G-1 illustrates an example in which the product of the refractive index and the thickness of the second intermediate layer is λ/2, the product of the refractive index and the thickness of the fourth intermediate layer is λ/2, the product of the refractive index and the thickness of the sixth intermediate layer is λ/2, and the second, fourth, and sixth intermediate layers meet the condition of the above expression (4). For the example of FIG. 3G-1, the phase difference between each of the resultant reflection vectors $r_1$ and $r_5$ and each of the resultant reflection vectors $r_3$ and $r_7$ is approximately π, as illustrated in FIG. 3G-2. Accordingly, each of the resultant reflection vectors $r_1$ and $r_5$ and each of the resultant reflection vectors $r_3$ and $r_7$ weaken each other, so the advantageous effects according to exemplary embodiments of the present invention are obtainable.

Figures 1, 3H:
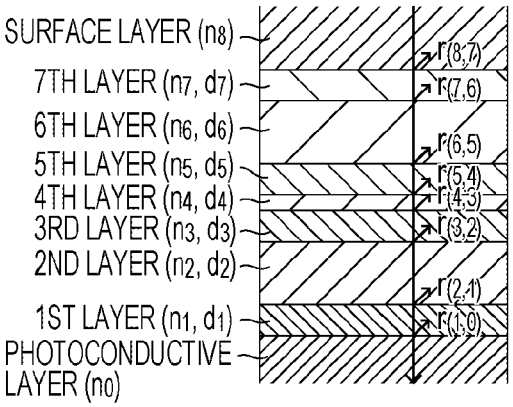
Figures 2, 3H:
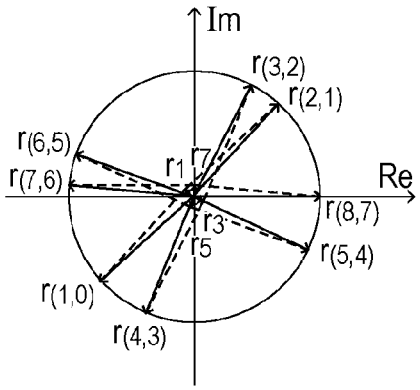

FIG. 3H-1 illustrates an example in which the product of the refractive index and the thickness of the second intermediate layer is λ/2, the product of the refractive index and the thickness of the fourth intermediate layer is λ/8, the product of the refractive index and the thickness of the sixth intermediate layer is λ/2, and the second and sixth intermediate layers meet the condition of the above expression (4). For the example of FIG. 3H-1, the phase difference between the resultant reflection vectors $r_1$ and $r_3$ and the phase difference between the resultant reflection vectors $r_5$ and $r_7$ are approximately π, as illustrated in FIG. 3G-2. Accordingly, the reflection vectors $r_1$ and $r_3$ weaken each other, and the resultant reflection vectors $r_5$ and $r_7$ weaken each other. Therefore, the advantageous effects according to exemplary embodiments of the present invention are obtainable.

Figures 1, 3I:
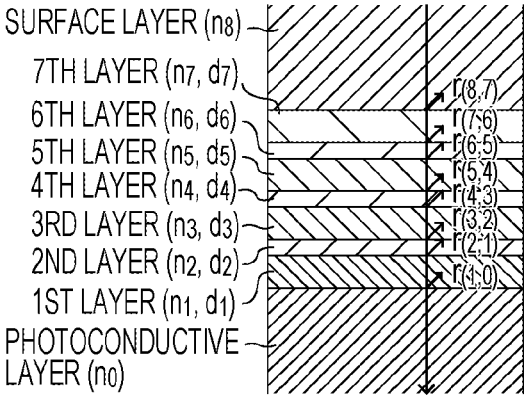
Figures 2, 3I:
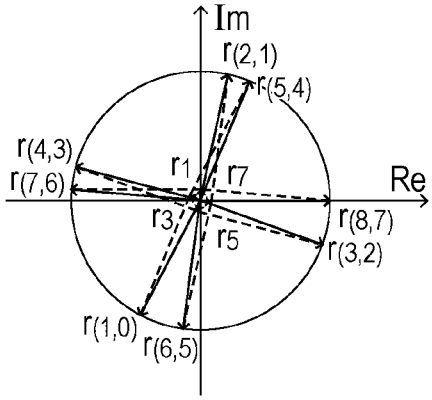
Figure 4B:
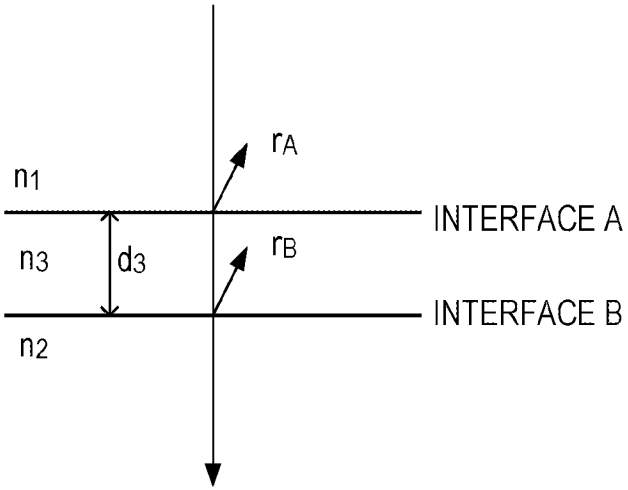
FIG. 4B illustrates reflected beams at interfaces with an antireflective layer.
Figure 4A:
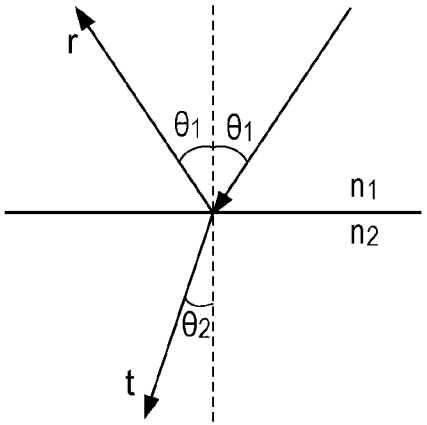
FIG. 4A illustrates a transmitted beam and a reflected beam when light is incident on an interface between media of different refractive indices.

FIG. 3I-1 illustrates an example in which the product of the refractive index and the thickness of the second intermediate layer is λ/8, the product of the refractive index and the thickness of the fourth intermediate layer is λ/8, the product of the refractive index and the thickness of the sixth intermediate layer is λ/8. Therefore, the sum of the products of the refractive indices and the thicknesses of the second to fourth intermediate layers is λ/2, and the condition of the above expression (4) is also met. In addition, each of the second, fourth, and sixth intermediate layers meets the condition of expression (10). For the example of FIG. 3I-1, the phase difference between the resultant reflection vectors $r_1$ and $r_5$ and that between the resultant reflection vectors $r_3$ and $r_7$ are approximately π, as illustrated in FIG. 3I-2. Accordingly, the resultant reflection vectors $r_1$ and $r_5$ weaken each other, and the resultant reflection vectors $r_3$ and $r_7$ weaken each other. In another respect, because the resultant reflection vectors $r_1$, $r_3$, $r_5$ and $r_7$ are arranged at substantially equal phase intervals, it can be said that the four resultant reflection vectors weaken each other. Therefore, the antireflective function is obtainable in a relatively wide wavelength range that contains the wavelength λ.

To obtain the advantageous effects according to exemplary embodiments of the present invention, the product of the refractive index and the thickness of an odd-numbered layer is to satisfied the condition of the above expression (3), and in one embodiment, the product may be equal to an odd multiple of λ/4. At least in the range of ±λ/64 from the optimum value, the advantageous effects according to exemplary embodiments of the present invention were observed. In consideration of an allowable range for a wavelength of an image exposure beam, it is useful that each odd-numbered layer be thin. $P_i$ in the above expression (3) may be 1 or 2.

An allowable range for a wavelength of an image exposure beam widens with an increase in the number of intermediate layers. In one embodiment, the number of intermediate layers may be five or more (N may be an odd number more than 4). However, because the number of steps in producing an electrophotographic photosensitive member increases with an increase in the number of intermediate layers, a huge number of intermediate layers may not be desirable from, for example, a cost perspective. If a digital electrophotographic apparatus that employs a laser diode (e.g., a semiconductor laser) or a light-emitting diode (LED) as an exposure light source, because a used wavelength range is relatively narrow, even when the number of intermediate layers is 11 or less (N is an odd number less than 12), the advantageous effects according to exemplary embodiments of the present invention are sufficiently obtainable.

To obtain the advantageous effects according to exemplary embodiments of the present invention more satisfactorily, it is useful that, for one or more even-numbered layers out of even-numbered layers, there exists $q_i$ for enabling the refractive index $n_i$ and the thickness $d_i$ [μm], $q_i$ being an integer equal to or more than 0, to satisfy the following expression (5). In particular, the product of the refractive index and the thickness of each of one or more even-numbered layers are to be adjusted to a multiple of λ/2. At least in the range of ±λ/32 from the optimum value, the advantageous effects according to exemplary embodiments of the present invention were observed.

$$\left|\frac{4\pi \cdot n_i \cdot d_i}{\lambda} - 2\pi \cdot q_i\right| \leq \frac{\pi}{8} \tag{5}$$

In particular, in consideration of an allowable range for a wavelength of an image exposure beam, it is useful that each even-numbered layer also be thin and $q_i$ in the above expression (5) be 1, 2, 3, or 4.

In particular, it is useful that the number of intermediate layers be 5 or more (N being an odd number more than 4), there exist $q_i$ for enabling the refractive index $n_i$ and the thickness $d_i$ [μm] of each of one or more even-numbered layers, $q_i$ being an integer equal to or more than 0, to satisfy the above expression (5), and there exist $p_i$ for enabling the refractive index $n_i$ and the thickness $d_i$ [μm] of the remaining even-numbered layers, $p_i$ being a positive integer, to satisfy the above expression (3).

It is useful that the number N of intermediate layers satisfy the following expression (6):

$$N=4\cdot k-1 \tag{6}$$

where k is a positive integer and that, among combinations in which two even-numbered layers substantially symmetrical with respect to the (2·k)th intermediate layer counting from the photoconductive layer side are selected, there exist at least one combination at which the refractive index $n_i$ and the thickness $d_i$ of each of the selected even-numbered layers satisfy the above expression (5). Examples of such a case include the cases illustrated in FIGS. 3B-1, 3E-1, 3G-1, and 3H-1, which are more useful because there are two sets of resultant reflection vectors weakening each other out of the four resultant reflection vectors $r_1$, $r_3$, $r_5$, and $r_7$. An example combination of the above-described two even-numbered layers is a combination of the second and sixth intermediate layers when the number of intermediate layers is 7 (k=2). Other such examples include a combination of the second and tenth intermediate layers and a combination of the fourth and eighth intermediate layers when the number of intermediate layers is 11 (k=3).

Also, it is useful that the number N of intermediate layers be an integer that satisfies the following expression (7):

$$N=4\cdot h+1 \tag{7}$$

where h is a positive integer and that, for each of the even-numbered layers, there exist $s_i$ for enabling the refractive index $n_i$ and the thickness $d_i$ [μm], $s_i$ being a positive integer at which $(2\cdot s_i-1)/(2\cdot h+1)$ is not an odd number, to satisfy the following expression (8), because resultant reflection vectors defined by reflected beams at two interfaces adjacent to each odd-numbered layer weaken each other.

$$\left|\frac{4\pi\cdot n_i\cdot d_i}{\lambda}-\frac{(2\cdot s_i-1)\pi}{2\cdot h+1}\right|\leq\frac{\pi}{16} \tag{8}$$

In particular, it is useful that $s_i$ in the above expression (8) be an integer that satisfies the following expression (9) ($s_a$ is a positive integer at which $(2\cdot s_a-1)/(2\cdot h+1)$ is not an odd number and $m_i$ is an integer equal to or more than 0), because resultant reflection vectors defined by reflected beams at two interfaces adjacent to each odd-numbered layer are arranged at substantially equal phase intervals with respect to the central wavelength.

$$S_i=S_a+(2\cdot h+1)m_i \tag{9}$$

In consideration of an allowable range for a wavelength of an image exposure beam, it is useful that each odd-numbered layer be thin. It is useful that $s_i$ in the above expression (8) be smaller than $(16\cdot h+9)/2$.

It is useful that the number N of intermediate layers be an integer that satisfies the following expression (6) and that there exist $u_i$ for enabling the refractive index and the thickness of each of the even-numbered layers, $u_i$ being a positive integer at which $u_i/(k+1)$ is not an odd number, to satisfy the following expression (10), because resultant reflection vectors defined by reflected beams at two interfaces adjacent to each odd-numbered layer weaken each other.

$$\left|\frac{4\pi\cdot n_i\cdot d_i}{\lambda}-\frac{\pi\cdot u_i}{k+1}\right|\leq\frac{\pi}{16} \tag{10}$$

In particular, it is useful that $u_i$, in the above expression (10) be an integer that satisfies the following expression (11) ($u_a$ being a positive integer at which $u_a/(k+1)$ is not an odd number and $v_i$ being an integer equal to or more than 0), because resultant reflection vectors defined by reflected beams at two interfaces adjacent to each odd-numbered layer are arranged at substantially equal phase intervals with respect to the central wavelength.

$$u_i=u_a=2(k-1)v_i \tag{11}$$

In consideration of an allowable range for a wavelength of an image exposure beam, it is useful that each odd-numbered layer be thin. It is useful that $u_i$ in the above expression (10) be equal to or less than 8(k+1).

In the case of an electrophotographic photosensitive member in which the photoconductive layer is a layer that includes amorphous silicon (hereinafter also referred to as "amorphous silicon photosensitive member), typically, layers are laminated on the base by, for example, plasma CVD. For such an electrophotographic photosensitive member, the refractive index of each of the photoconductive layer, the intermediate layers, and the surface layer can be easily adjusted by adjustment of the flow rate and the flow ratio of silane ($SiH_4$) gas used in material gas of the photoconductive layer and other types of material gas added to the silane gas, such as methane ($CH_4$), nitrogen ($N_2$), and ammonia ($NH_3$), the reaction pressure, the applied voltage, or other factors. The thickness of each layer can be adjusted by controlling the period of time of formation and the formation speed. In the case of an electrophotographic photosensitive member in which the photoconductive layer is a layer that includes amorphous silicon, it is useful that each of the intermediate layers and the surface layer be a layer that includes amorphous silicon carbide, amorphous silicon nitride, or amorphous silicon oxide.

EXAMPLES

Example 1 and Comparative Example 1

Production of Electrophotographic Photosensitive Member (Amorphous Silicon Photosensitive Member)

Figure 5:
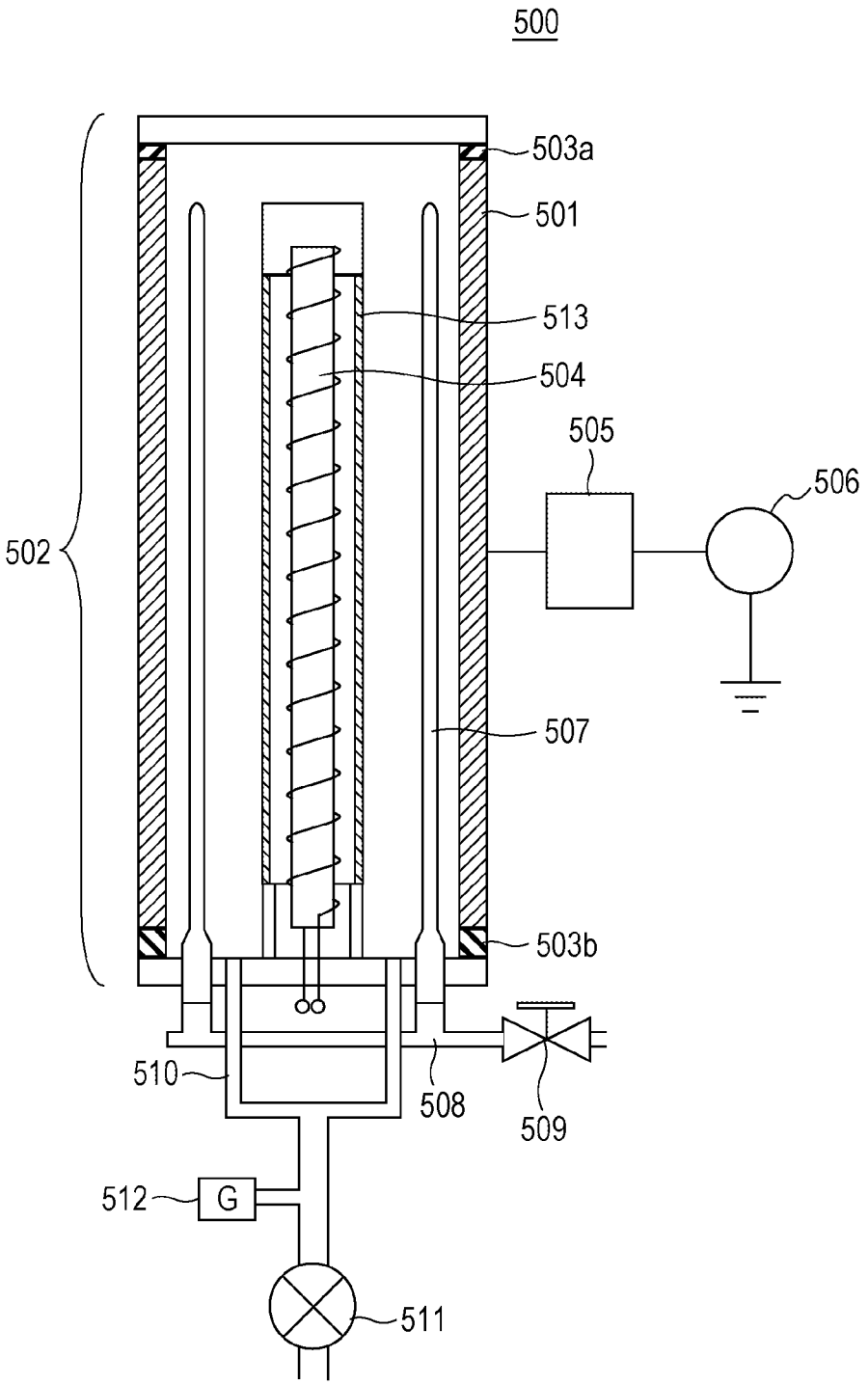
FIG. 5 illustrates a plasma chemical-vapor deposition (CVD) apparatus for producing an amorphous silicon photosensitive member.

In the present examples, an electrophotographic photosensitive member (amorphous silicon photosensitive member) was produced using a plasma CVD apparatus illustrated in FIG. 5.

A plasma CVD apparatus 500 illustrated in FIG. 5 includes, in a reactor 502, a substantially cylindrical conductive base 513 connected to the earth, a heater 504, and a material gas supply pipe 507. A cathode electrode 501 is connected to a high-frequency power source 506 through an impedance matching circuit 505. The reactor 502 includes insulators 503*a* and 503*b*.

A material gas supply apparatus (not illustrated) is connected upstream of a material gas supply valve 509 and is configured to be able to supply the inside of the reactor 502 with material gas, such as silane ($SiH_4$), hydrogen ($H_2$), methane ($CH_4$), nitric oxide (NO), diborane ($B_2H_6$), phosphine ($PH_3$), tetrafluoromethane ($CF_4$), argon (Ar), helium (He) at a specific flow rate through the material gas supply pipe 507. The material gas supply valve 509 is connected to a gas splitter 508. An exhaust apparatus (not illustrated) is connected downstream of a main exhaust valve 511 and is configured to be able to reduce the pressure of the inside of the reactor 502. The main exhaust valve 511 is connected to an exhaust pipe arrangement 510 and a pressure gauge 512.

Next, a procedure for producing an amorphous silicon photosensitive member using the plasma CVD apparatus illustrated in FIG. 5 is described.

First, the surface of the aluminum base 513 having a substantially cylindrical shape with dimensions of approximately 84 mm in diameter, 381 mm in length, and 3 mm in thickness is subjected to mirror processing and degreasing cleaning is performed thereon. The cleaned base 513 is placed in the reactor 502. Then, the exhaust apparatus (not illustrated) is actuated to exhaust air from the reactor 502. When the pressure gauge 512 reads a specific pressure, e.g., no more than 1 Pa for the pressure of the inside of the reactor 502, a power is supplied to the heater 504 to heat the base 513 to a specific temperature, e.g., in the range of 50° C. to 350° C. At this time, the gas supply apparatus (not illustrated) can also supply the inside of the reactor 502 with inert gas, such as argon or helium, through the material gas supply pipe 507 such that the base is heated in the inert gas environment.

Next, in accordance with the formation conditions illustrated in Table 1, the gas supply apparatus (not illustrated) supplies the inside of the reactor 502 with material gas for use in forming the lower blocking layer at a specific flow rate. At the same time, the exhaust valve 511 is manipulated while the indication of the pressure gauge 512 is observed to adjust the pressure of the inside of the reactor 502 so as to be a specific value. When the specific pressure is reached, the high-frequency power source 506 applies a high-frequency electric power and the impedance matching circuit 505 is manipulated to cause plasma radiation to occur in the reactor 502. After that, the high-frequency electric power is quickly adjusted to a specific electric power to form the lower blocking layer. When the thickness of the lower blocking layer reaches a specific value, the application of the high-frequency electric power is stopped, and the formation of the lower blocking layer is completed.

With a similar process, the photoconductive layer, the intermediate layers, and the surface layer are sequentially formed. A varying layer may be formed between the lower blocking layer and the photoconductive layer by continuously forming them while changing, for example, the flow rate of the material gas, the pressure, the electric power. The photoconductive layer may have a multilayer structure that has layers with different functions, such as a charge transport layer and a charge generating layer.

When all layers have been formed, the material gas supply valve 509 is closed to finish supplying the material gas, the main exhaust valve 511 is opened, and the inside of the reactor 502 is exhausted until its pressure becomes a specific pressure, for example, no more than 1 Pa.

After the exhaustion, the inside of the reactor 502 may be purged if needed, the main exhaust valve 511 is closed, inert gas is supplied from the gas supply apparatus (not illustrated) to the inside of the reactor 502 through the material gas supply pipe 507, the inside is returned to atmospheric pressure, and then the base 513 is extracted.

Figure 6:
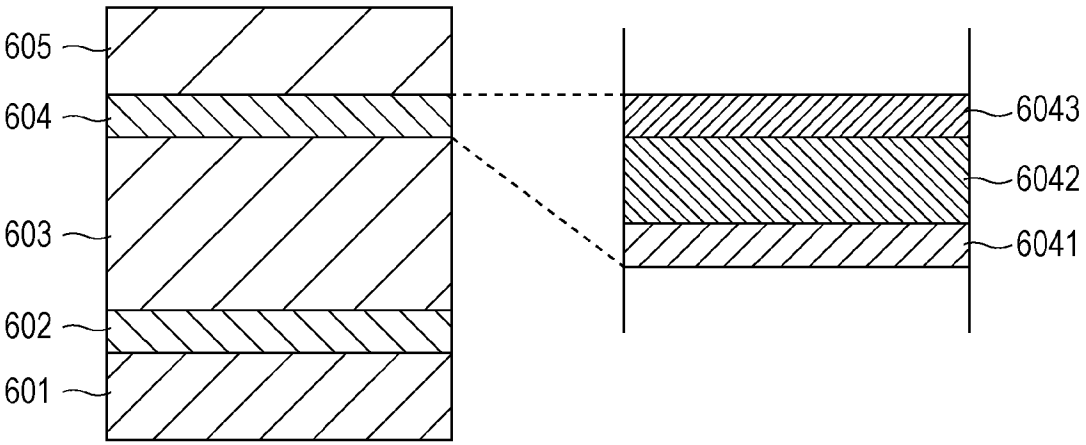
FIG. 6 is a cross-sectional view of an electrophotographic photosensitive member including three intermediate layers produced in an example of the present invention.

With the present examples and comparative examples, an amorphous silicon photosensitive member having a layer structure illustrated in FIG. 6 was produced. The layer structure includes a conductive base 601, a lower blocking layer 602, a photoconductive layer 603, an interlayer section 604 including intermediate layers 6041 to 6043, and a surface layer 605. For the present examples, an amorphous silicon photosensitive member including three intermediate layers containing the second intermediate layer functioning as an upper blocking layer and being for use in negative charging was produced. Two amorphous silicon photosensitive members were produced in the examples 1-4 and 1-7 and the comparative example 1-1, whereas a single amorphous silicon photosensitive member was produced in the other examples and comparative examples. The refractive index of each odd-numbered layer was adjusted to the geometrical mean of the refractive indices of the two even-numbered layers adjacent to the odd-numbered layer. The refractive indices of the layers were measured using a spectroscopic ellipsometer (measuring instrument: M-2000 from J. A. Woollam Co., Inc.; analyzing software: WVASE32). As measurement conditions, the angle of incidence was 60, 65, and 70 degrees. The wavelength dispersion of the refractive index of each layer was calculated using the analyzing software from obtained data, and the refractive index at the wavelength 0.66 μm (660 nm) was regarded as a measure of central tendency.

The thickness of the second intermediate layer in each of the examples and the comparative examples was changed to the condition shown in Table 2. The first and third intermediate layers were adjusted so as to have a thickness at which $4\pi nd/\lambda$ was $\pi$. $\lambda$ is 0.66 μm (660 nm).

TABLE 1

| Formation Conditions | | Lower Blocking Layer | Photoconductive Layer | Intermediate Layers 1st Layer | 2nd Layer | 3rd Layer | Surface Layer |
|---|---|---|---|---|---|---|---|
| Gas Type and Flow Rate | | | | | | | |
| $SiH_4$ | (ml/min.(normal)) | 300 | 400 | 310 | 230 | 70 | 25 |
| $CH_4$ | (ml/min.(normal)) | 0 | 0 | 130 | 230 | 580 | 1400 |
| $H_2$ | (ml/min.(normal)) | 300 | 2000 | 0 | 0 | 0 | 0 |
| $B_2H_6$ | (ppm (to $SiH_4$)) | 0 | 0 | 0 | 150 | 0 | 0 |
| NO | (ml/min.(normal)) | 24 | 0 | 0 | 0 | 0 | 0 |
| Reaction Pressure | (Pa) | 40 | 70 | 50 | 50 | 50 | 50 |
| Electric Power | (W) | 500 | 1000 | 400 | 400 | 400 | 400 |
| Temperature of Base | (° C.) | 210 | 210 | 230 | 230 | 230 | 230 |
| Refractive Index n | | | 3.51 | 3.15 | 2.83 | 2.39 | 2.02 |
| Thickness d | (μm) | 3 | 30 | 0.052 | *Tab. 2 | 0.069 | 0.5 |
| $4\pi nd/\lambda$ | | | | $\pi$ | *Tab. 2 | $\pi$ | |

TABLE 2

| | | 2nd Int. Layer Thickness d(μm) | $4\pi nd/\lambda$ | Evaluation Results Evaluation 1 | Evaluation 2 | Evaluation 3 |
|---|---|---|---|---|---|---|
| Example | 1-1 | 0.095 | $2\pi - 3\pi/8$ | C | C | — |
| | 1-2 | 0.102 | $2\pi - \pi/4$ | C | C | — |
| | 1-3 | 0.109 | $2\pi - \pi/8$ | B | B | — |
| | 1-4 | 0.117 | $2\pi$ | B | B | B |
| | 1-5 | 0.124 | $2\pi + \pi/8$ | B | B | — |
| | 1-6 | 0.131 | $2\pi + \pi/4$ | C | C | — |
| | 1-7 | 0.138 | $2\pi + 3\pi/8$ | C | C | C |
| Comparative Example | 1-1 | 0.058 | $\pi$ | — | — | — |
| | 1-2 | 0.087 | $2\pi - \pi/2$ | D | D | — |
| | 1-3 | 0.146 | $2\pi + \pi/2$ | D | D | — |

<Evaluation 1>

A variation in sensitivity of each of the electrophotographic photosensitive members produced in the present examples and comparative examples caused by wearing of the surface layer is alternatively evaluated by a method described below.

First, in order to reproduce wearing of the surface layer, the surface layer was ground using a grinding machine. The variation in sensitivity was alternatively evaluated by measuring the reflectance of an electrophotographic photosensitive member.

In the grinding of the surface layer, a grinding machine for running over the surface of an electrophotographic photosensitive member with a magnetic brush bearing magnetic powder on its magnetic roller was used. In the grinding, the electrophotographic photosensitive member was rotated at approximately 90 rpm and a magnet roller having a diameter of approximately 16 mm and incorporating a magnet having a magnetic pole of approximately 900 G in the direction of the electrophotographic photosensitive member was rotated at approximately 240 rpm in a direction opposite to the rotation direction of the electrophotographic photosensitive member. The gap between the electrophotographic photosensitive member and the magnet roller was adjusted to approximately 0.4 mm, the gap between the magnet roller and a plate magnetic regulating blade was adjusted to approximately 1.0 mm. As the magnetic powder, Cu—Zn ferrite (trade name: DFC450) from Dowa Teppun Kogyo Corp. (now Dowa IP Creation Co., Ltd.) was used.

In the measurement of the reflectance, a wavelength range from approximately 0.64 to 0.68 μm (640 to 680 nm) was evaluated using a spectrophotometer (trade name: MCPD-2000) from Otsuka Electronics Co., Ltd. The wavelength range used in evaluation was determined, considering that the oscillation wavelength of a light source for an image exposure beam incorporated in an electrophotographic apparatus that includes an amorphous silicon photosensitive member is 660 nm (0.66 μm) in many cases and in consideration of half-width and temperature dependence.

The variation in sensitivity of an electrophotographic photosensitive member were defined and measured by a method described below.

First, reflectance for each wavelength in the range from approximately 0.64 to 0.68 μm (640 to 680 nm) of a produced electrophotographic photosensitive member was measured using the above-described apparatus, and such measurement was conducted every time grinding was made using the grinding machine for a predetermined period of time (for a predetermined period of time until the grinding of the surface layer by approximately 10 nm). The difference between the maximum value and the minimum value of reflectance and the mean value (arithmetic mean) for each wavelength until the completion of grinding of the surface layer by approximately 200 nm were calculated, and the value obtained by dividing the difference between the maximum value and the minimum value by the mean value was regarded as the degree of variation for each wavelength. Among the values of the degree of variation at wavelengths, the maximum value was regarded as a measure of central tendency and defined as the variation in sensitivity of the electrophotographic photosensitive member.

Where the variation in sensitivity (degree of variation: 0.26) of an electrophotographic photosensitive member produced in the comparative example 1-1 was set as a criterion value, a variation in sensitivity was rated:

A when it was less than 30% of the criteria value;

B when it was equal to or more than 30% and less than 60% of the criteria value;

C when it was equal to or more than 60% and less than 90% of the criteria value;

D when it was equal to or more than 90% and less than 110% of the criteria value; and E when it was equal to or more than 110% of the criteria value.

That is, the evaluation results A, B, and C are considered to achieve the advantageous effects according to exemplary embodiments of the present invention. The evaluation results are shown in Table 2. The evaluation reveals that the examples 1, where $4\pi nd/\lambda$ of the second intermediate layer, which is an even-numbered layer, is more than $3\pi/2$ and less than $5\pi/2$, achieved good results. In particular, cases where $4\pi nd/\lambda$ is $2\pi\pm\pi/8$ achieved better results.

<Evaluation 2>

Electrophotographic photosensitive members produced in the present examples and comparative examples were evaluated when being mounted on a modified machine of an electrophotographic apparatus from CANON KABUSHIKI KAISHA (trade name: iRC6800). The modification of the modified machine is described below.

A light source for an image exposure beam was changed from a laser diode (semiconductor laser) whose central oscillation wavelength was 0.66 μm (660 nm) to a laser diode (semiconductor laser) whose central oscillation wavelength was 0.68 μm (680 nm). Primary charging was negative charging, and the exposure system was changed to a digital-imaging exposure system to use a reversal developing process in the exposure system. A surface electrometer was placed instead of a black developing device. Before grinding of the surface layer, a charging condition in which the potential of a dark region of an electrophotographic photosensitive member was −500 V and an exposure condition in which the potential of a light region thereof was −150 V were determined.

Every time the surface layer was ground by approximately 10 nm in the evaluation 1, the electrophotographic photosensitive member was mounted on the above-described modified machine of the electrophotographic apparatus, a solid white image (entirely unexposed) and a solid black image (entirely exposed) were output under the aforementioned charging condition and exposure condition, and the potential of the dark region and the potential of the light region were measured. The difference between the potential of the dark region and that of the light region was defined as sensitivity, and the difference of the maximum value and the minimum value of the sensitivity until the completion of grinding of the surface layer by approximately 200 nm was defined as a variation in sensitivity.

Where the variation in sensitivity (11V) of an electrophotographic photosensitive member produced in the comparative example 1-1 was set as a criterion value, a variation in sensitivity was rated:

A when it was less than 30% of the criteria value;

B when it was equal to or more than 30% and less than 60% of the criteria value;

C when it was equal to or more than 60% and less than 90% of the criteria value;

D when it was equal to or more than 90% and less than 110% of the criteria value; and E when it was equal to or more than 110% of the criteria value.

That is, the evaluation results A, B, and C are considered to achieve the advantageous effects according to exemplary embodiments of the present invention. The evaluation results are shown in Table 2.

The evaluation reveals that the examples 1, where $4\pi nd/\lambda$ of the second intermediate layer, which is an even-numbered layer, is more than $3\pi/2$ and less than $5\pi/2$, achieved good results.

The results of the evaluation 2 are the same as those of the evaluation 1. Therefore, the advantageous effects according to exemplary embodiments of the present invention can be examined by the evaluation 1.

<Evaluation 3>

Amorphous silicon photosensitive members produced in the examples 1-4 and 1-7 and comparative example 1-1 were evaluated for a variation in sensitivity with real operating environment considered using the modified machine of the electrophotographic apparatus employed in the evaluation 2. In this evaluation, a black developing device was placed instead of a surface electrometer, and an image with an A4 test pattern of 4% coverage was output on 2-million pages. At the beginning and every a hundred thousand, a surface electrometer was placed instead of the black developing device, and sensitivity was measured by substantially the same method as in the evaluation 2. The difference between the maximum value and the minimum value of the sensitivity until the completion of a continuous printing test of 2-million pages was defined as a variation in sensitivity.

Where the variation in sensitivity (11V) of an electrophotographic photosensitive member produced in the comparative example 1-1 was set as a criterion value, a variation in sensitivity was rated:

A when it was less than 30% of the criteria value;

B when it was equal to or more than 30% and less than 60% of the criteria value;

C when it was equal to or more than 60% and less than 90% of the criteria value;

D when it was equal to or more than 90% and less than 110% of the criteria value; and E when it was equal to or more than 110% of the criteria value.

That is, the evaluation results A, B, and C are considered to achieve the advantageous effects according to exemplary embodiments of the present invention. The evaluation results are shown in Table 2.

The evaluation reveals that the examples 1, where $4\pi nd/\lambda$ of the second intermediate layer, which is an even-numbered layer, is more than $3\pi/2$ and less than $5\pi/2$, achieved good results.

The results of the evaluation 3 are the same as those of the evaluation 1. Therefore, the advantageous effects according to exemplary embodiments of the present invention can be examined by the evaluation 1.

Example 2 and Comparative Example 2

A single amorphous silicon photosensitive member was produced for each of the present examples and comparative examples under substantially the same formation conditions as in the example 1-4 using the same modified machine of the electrophotographic apparatus as in the examples 1. Note that the thickness of the third intermediate layer was changed to the various conditions shown in Table 3. A variation in sensitivity in the amorphous silicon photosensitive member was evaluated by the method and criterion described in the evaluation 1 of the examples 1. The results of the evaluation are shown in Table 3.

The evaluation reveals that the examples 2, where $4\pi nd/\lambda$ of the third intermediate layer, which is an odd-numbered layer, is in the range of $\pi \pm \pi/16$, achieved better results.

TABLE 3

| | | 3rd Int. Layer | | |
|---|---|---|---|---|
| | | Thickness d(μm) | $4\pi nd/\lambda$ | Evaluation Results |
| Example | 2-1 | 0.073 | $\pi - \pi/16$ | C |
| | 2-2 | 0.071 | $\pi - \pi/32$ | B |
| | 1-4 | 0.069 | $\pi$ | B |
| | 2-3 | 0.067 | $\pi + \pi/32$ | B |
| | 2-4 | 0.065 | $\pi + \pi/16$ | C |
| Comparative Example | 2-1 | 0.075 | $\pi - 3\pi/32$ | D |
| | 2-2 | 0.063 | $\pi + 3\pi/32$ | D |

Example 3 and Comparative Example 3

A single amorphous silicon photosensitive member was produced for each of the present examples and comparative examples under substantially the same formation conditions as in the example 1-4 using the same modified machine of the electrophotographic apparatus as in the examples 1. Note that the refractive index and the thickness of the third intermediate layer were changed to the various conditions shown in Table 4. The thickness was adjusted such that $4\pi nd/\lambda$ of the third intermediate layer in each of the examples was the same as $\pi$. A variation in sensitivity in the amorphous silicon photosensitive member was evaluated by the method and criterion described in the evaluation 1 of the examples 1. The results of the evaluation are shown in Table 4.

The evaluation reveals that the examples 3, where the refractive index of the third intermediate layer is in the range of ±2% of the geometrical mean of the refractive index of the second intermediate layer and the refractive index of the surface layer, achieved better results.

TABLE 4

| | | 3rd Int. Layer | | | |
|---|---|---|---|---|---|
| | | Refractive Index n | Value of Left Side of Expression (2) | Thickness d(μm) | Evaluation Results |
| Example | 3-1 | 2.35 | −0.02 | 0.070 | C |
| | 3-2 | 2.37 | −0.01 | 0.070 | B |
| | 1-4 | 2.39 | 0 | 0.069 | B |
| | 3-3 | 2.41 | +0.01 | 0.068 | B |
| | 3-4 | 2.44 | +0.02 | 0.068 | C |
| Comparative Example | 3-1 | 2.33 | −0.03 | 0.071 | D |
| | 3-2 | 2.46 | +0.03 | 0.067 | D |

Example 4 and Comparative Example 4

In the present examples, an amorphous silicon photosensitive member including five intermediate layers was produced using the same modified machine of the electrophotographic apparatus as in the examples 1. In the present examples, the intermediate layers were set at the conditions shown in Table 5, and the function as an upper blocking layer was provided to the second intermediate layer. The other layers were set at the same conditions as in the examples 1. A single amorphous silicon photosensitive member was produced for each of the present examples and comparative example. Of the intermediate layers, each of the odd-numbered layers was adjusted such that its refractive index was the same as the geometrical mean of the refractive indices of the two even-numbered layers adjacent to the odd-numbered layer and such that its thickness was a thickness at which $4\pi nd/\lambda$ was the same as $\pi$. The thickness of each even-numbered layer was changed to the various conditions shown in Table 6. A variation in sensitivity in the amorphous silicon photosensitive member was evaluated by the method and criterion described in the evaluation 1 of the examples 1. The results of the evaluation are shown in Table 6.

The evaluation reveals that the examples 4-1 and 4-2, where when the sum of the products of the refractive indices and thicknesses of the second to fourth intermediate layers is $\Sigma nd$, $4\pi\Sigma nd/\lambda$ is a multiple of $2\pi$, achieved a good advantageous effect of suppressing a variation in sensitivity. The examples 4-3 to 4-6, where $4\pi nd/\lambda$ of at least one even-numbered layer is $2\pi$, achieved better results.

In contrast, for the comparative example 4, where $4\pi nd/\lambda$ of each of all intermediate layers is $\pi$, because the resultant reflection vectors do not weaken each other, the advantageous effects were not obtained.

TABLE 5

| Formation Conditions | | Intermediate Layers 1st Layer | 2nd Layer | 3rd Layer | 4th Layer | 5th Layer |
|---|---|---|---|---|---|---|
| Gas Type and Flow Rate | | | | | | |
| $SiH_4$ | (ml/min.(normal)) | 310 | 230 | 160 | 80 | 55 |
| $CH_4$ | (ml/min.(normal)) | 120 | 230 | 350 | 450 | 760 |
| $B_2H_6$ | (ppm (to $SiH_4$)) | 0 | 150 | 0 | 0 | 0 |
| Reaction Pressure | (Pa) | 50 | 50 | 50 | 50 | 50 |
| Electric Power | (W) | 400 | 400 | 400 | 400 | 400 |
| Temperature of Base | (° C.) | 230 | 230 | 230 | 230 | 230 |
| Refractive Index n | | 3.15 | 2.83 | 2.62 | 2.43 | 2.22 |
| Thickness d | (μm) | 0.052 | *Tab. 6 | 0.063 | *Tab. 6 | 0.074 |
| $4\pi nd/\lambda$ | | $\pi$ | *Tab. 6 | $\pi$ | *Tab. 6 | $\pi$ |

TABLE 6

| | | 2nd Int. Layer Thickness d(μm) | 2nd Int. Layer $4\pi nd/\lambda$ | 4th Int. Layer Thickness d(μm) | 4th Int. Layer $4\pi nd/\lambda$ | Evaluation Results |
|---|---|---|---|---|---|---|
| Example | 4-1 | 0.029 | $\pi/2$ | 0.034 | $\pi/2$ | B |
| | 4-2 | 0.087 | $3\pi/2$ | 0.102 | $3\pi/2$ | B |
| | 4-3 | 0.117 | $2\pi$ | 0.068 | $\pi$ | B |
| | 4-4 | 0.058 | $\pi$ | 0.136 | $2\pi$ | B |
| | 4-5 | 0.117 | $2\pi$ | 0.136 | $2\pi$ | C |
| | 4-6 | 0.117 | $2\pi$ | 0.034 | $\pi/2$ | B |
| Comparative Example | 4 | 0.058 | $\pi$ | 0.068 | $\pi$ | D |

Example 5 and Comparative Example 5

In the present examples and comparative example, an amorphous silicon photosensitive member including seven intermediate layers was produced using the same modified machine of the electrophotographic apparatus as in the examples 1. In the present examples, the intermediate layers were set at the conditions shown in Table 7, and the function as an upper blocking layer was provided to the fourth intermediate layer. The other layers were set at the same conditions as in the examples 1. A single amorphous silicon photosensitive member was produced for each of the present examples and comparative example. Of the intermediate layers, each of the odd-numbered layers was adjusted such that its refractive index was the same as the geometrical mean of the refractive indices of the two even-numbered layers adjacent to the odd-numbered layer and such that its thickness was the same as a thickness at which $4\pi nd/\lambda$ was the same as $\pi$. The thickness of each even-numbered layer was changed to the various conditions shown in Table 8. A variation in sensitivity in the amorphous silicon photosensitive member was evaluated by the method and criterion described in the evaluation 1 of the examples 1. The results of the evaluation are shown in Table 8.

The evaluation reveals that all the examples, where at least one of the even-numbered layers has a thickness at which $4\pi nd/\lambda$ is the same as $2\pi$, achieved a good advantageous effect of suppressing a variation in sensitivity. In particular, the examples 5-2, 5-4, 5-6, and 5-8, where, with respect to the fourth intermediate layer, arrangement of the expression satisfied by each intermediate layer is substantially symmetrical ($4\pi nd/\lambda$ of the second intermediate layer and $4\pi nd/\lambda$ of the sixth intermediate layer are the same), achieved better results.

In contrast, for the comparative example 5, where $4\pi nd/\lambda$ of each of all intermediate layers is $\pi$, because the resultant reflection vectors do not weaken each other, the advantageous effects were not obtained.

TABLE 7

| Formation Conditions | | Intermediate Layers 1st Layer | 2nd Layer | 3rd Layer | 4th Layer | 5th Layer | 6th Layer | 7th Layer |
|---|---|---|---|---|---|---|---|---|
| Gas Type and Flow Rate | | | | | | | | |
| $SiH_4$ | (ml/min.(normal)) | 360 | 310 | 270 | 230 | 160 | 80 | 55 |
| $CH_4$ | (ml/min.(normal)) | 50 | 120 | 170 | 230 | 350 | 450 | 760 |
| $B_2H_6$ | (ppm (to $SiH_4$)) | 0 | 0 | 0 | 150 | 0 | 0 | 0 |

TABLE 7-continued

| Formation Conditions | | Intermediate Layers 1st Layer | 2nd Layer | 3rd Layer | 4th Layer | 5th Layer | 6th Layer | 7th Layer |
|---|---|---|---|---|---|---|---|---|
| Reaction Pressure | (Pa) | 50 | 50 | 50 | 50 | 50 | 50 | 50 |
| Electric Power | (W) | 400 | 400 | 400 | 400 | 400 | 400 | 400 |
| Temperature of Base | (° C.) | 230 | 230 | 230 | 230 | 230 | 230 | 230 |
| Refractive Index n | | 3.33 | 3.16 | 2.99 | 2.83 | 2.62 | 2.43 | 2.22 |
| Thickness d | (μm) | 0.050 | *Tab. 8 | 0.055 | *Tab. 8 | 0.063 | *Tab. 8 | 0.074 |
| 4πnd/λ | | π | *Tab. 8 | π | *Tab. 8 | π | *Tab. 8 | π |

TABLE 8

| | | 2nd Int. Layer Thickness d(μm) | 4πnd/λ | 4th Int. Layer Thickness d(μm) | 4πnd/λ | 6th Int. Layer Thickness d(μm) | 4πnd/λ | Evaluation Results |
|---|---|---|---|---|---|---|---|---|
| Example | 5-1 | 0.104 | 2π | 0.117 | 2π | 0.068 | π | B |
| | 5-2 | 0.104 | 2π | 0.058 | π | 0.136 | 2π | A |
| | 5-3 | 0.052 | π | 0.117 | 2π | 0.136 | 2π | B |
| | 5-4 | 0.104 | 2π | 0.117 | 2π | 0.136 | 2π | A |
| | 5-5 | 0.052 | π | 0.058 | π | 0.136 | 2π | B |
| | 5-6 | 0.052 | π | 0.117 | 2π | 0.068 | π | A |
| | 5-7 | 0.104 | 2π | 0.058 | π | 0.068 | π | B |
| | 5-8 | 0.104 | 2π | 0.029 | π/2 | 0.136 | 2π | A |
| Comparative Example | 5 | 1.052 | π | 1.058 | π | 1.136 | π | D |

Example 6

In the present examples, an amorphous silicon photosensitive member substantially the same as that of the example 1-4 was produced using the same modified machine of the electrophotographic apparatus as in the examples 1 by substantially the same method. In the present examples, the thickness of the second intermediate layer was changed to that shown in Table 9. A single amorphous silicon photosensitive member was produced for each of the present examples. A variation in sensitivity in the amorphous silicon photosensitive member was evaluated by the method and criterion described in the evaluation 1 of the examples 1. The results of the evaluation are shown in Table 9.

The evaluation reveals that the present examples, where the thickness of the second intermediate layer, which is an even-numbered layer, is adjusted such that 4πnd/λ is an even multiple of π, achieved a good advantageous effect of suppressing a variation in sensitivity. Note that the thinner the second intermediate layer the better the effect, and a region in which the thickness thereof was a thickness at which 4πnd/λ was equal to or less than 8π ($q_i$=4 in the above expression (5)) was more useful. That is, $q_i$ in the above expression (4) may be 1, 2, 3, or 4.

TABLE 9

| | | 2nd Int. Layer Thickness d(μm) | qi of Expression (5) | 4πnd/λ | Evaluation Results |
|---|---|---|---|---|---|
| Example | 1-4 | 0.117 | 1 | 2π | B |
| | 6-1 | 0.233 | 2 | 4π | B |
| | 6-2 | 0.350 | 3 | 6π | B |

TABLE 9-continued

| | 2nd Int. Layer Thickness d(μm) | qi of Expression (5) | 4πnd/λ | Evaluation Results |
|---|---|---|---|---|
| 6-3 | 0.466 | 4 | 8π | B |
| 6-4 | 0.583 | 5 | 10π | C |

Example 7

In the present examples, an amorphous silicon photosensitive member substantially the same as that of the example 1-4 was produced using the same modified machine of the electrophotographic apparatus as in the examples 1 by substantially the same method. In the present examples, the thickness of each of the first and third intermediate layers was changed to that shown in Table 10. A single amorphous silicon photosensitive member was produced for each of the present examples. A variation in sensitivity in the amorphous silicon photosensitive member was evaluated by the method and criterion described in the evaluation 1 of the examples 1. The results of the evaluation are shown in Table 10.

The evaluation reveals that the present examples, where the thicknesses of the first intermediate layer and the third intermediate layer, which are odd-numbered layers, is adjusted such that 4πnd/λ is an odd multiple of π, achieved a good advantageous effect of suppressing a variation in sensitivity. Note that the thinner the first and third intermediate layers the better the effect, and a region in which the thickness thereof was a thickness at which 4πnd/λ was equal to or less than 3π ($p_i$=2 in the above expression (3)) was more useful. That is, $p_i$ in the above expression (3) may be 1 or 2.

TABLE 10

| | | 1st Int. Layer | | | 3rd Int. Layer | | | |
|---|---|---|---|---|---|---|---|---|
| | | Thickness d(μm) | pi of Expression (3) | 4πnd/λ | Thickness d(μm) | pi of Expression (3) | 4πnd/λ | Evaluation Results |
| Example | 1-4 | 0.052 | 1 | π | 0.069 | 1 | π | B |
| | 7-1 | 0.157 | 2 | 3π | 0.207 | 2 | 3π | B |
| | 7-2 | 0.261 | 3 | 5π | 0.345 | 3 | 5π | C |

Example 8

In the present examples, an amorphous silicon photosensitive member substantially the same as that of the examples 4 and including five intermediate layers was produced. Note that the thickness of each even-numbered layer was changed to the condition shown in Table 11. A single amorphous silicon photosensitive member was produced for each of the present examples. A variation in sensitivity in the amorphous silicon photosensitive member was evaluated by the method and criterion described in the evaluation 1 of the examples 1. The results of the evaluation are shown in Table 11.

The evaluation reveals that the present examples, where their even-numbered layers satisfy the condition of the above expression (8), achieved a good advantageous effect of suppressing a variation in sensitivity. In particular, the examples 8-1 to 8-5, 8-8, and 8-9, which satisfy the condition of the above expression (9), achieved a better effect. Note that the thinner each even-numbered layer the better the effect, and a region in which the thickness thereof was a thickness at which 4πnd/λ was equal to or less than 23π/3 was more useful.

TABLE 11

| | | 2nd Int. Layer | | 4th Int. Layer | | |
|---|---|---|---|---|---|---|
| | | Thickness d(μm) | 4πnd/λ | Thickness d(μm) | 4πnd/λ | Evaluation Results |
| Example | 8-1 | 0.019 | π/3 | 0.023 | π/3 | A |
| | 8-2 | 0.097 | 5π/3 | 0.113 | 5π/3 | B |
| | 8-3 | 0.214 | 11π/3 | 0.249 | 11π/3 | B |
| | 8-4 | 0.330 | 17π/3 | 0.385 | 17π/3 | B |
| | 8-5 | 0.447 | 23π/3 | 0.521 | 23π/3 | B |
| | 8-6 | 0.564 | 29π/3 | 0.656 | 29π/3 | C |
| | 8-7 | 0.097 | 5π/3 | 0.023 | π/3 | C |
| | 8-8 | 0.136 | 7π/3 | 0.023 | π/3 | A |
| | 8-9 | 0.214 | 11π/3 | 0.113 | 5π/3 | B |

Example 9

In the present examples, an amorphous silicon photosensitive member substantially the same as that of the examples 5 and including seven intermediate layers was produced. Note that the thickness of each even-numbered layer was changed to the condition shown in Table 12. A single amorphous silicon photosensitive member was produced for each of the present examples. A variation in sensitivity in the amorphous silicon photosensitive member was evaluated by the method and criterion described in the evaluation 1 of the examples 1. The results of the evaluation are shown in Table 12.

The evaluation reveals that the present examples, where their even-numbered layers satisfy the condition of the above expression (10), achieved a good advantageous effect of suppressing a variation in sensitivity. In particular, the examples 9-1 to 9-6 and 9-8, which satisfy the condition of the above expression (11), achieved a better effect. Note that the thinner each even-numbered layer the better the effect, and a region in which the thickness thereof is a thickness at which 4πnd/λ was equal to or less than 15π/2 was more useful.

TABLE 12

| | | 2nd Int. Layer | | 4th Int. Layer | | 6th Int. Layer | | |
|---|---|---|---|---|---|---|---|---|
| | | Thickness d(μm) | 4πnd/λ | Thickness d(μm) | 4πnd/λ | Thickness d(μm) | 4πnd/λ | Evaluation Results |
| Example | 9-1 | 0.026 | π/2 | 0.029 | π/2 | 0.034 | π/2 | A |
| | 9-2 | 0.078 | 3π/2 | 0.087 | 3π/2 | 0.102 | 3π/2 | A |
| | 9-3 | 0.131 | 5π/2 | 0.146 | 5π/2 | 0.170 | 5π/2 | A |
| | 9-4 | 0.183 | 7π/2 | 0.204 | 7π/2 | 0.238 | 7π/2 | B |
| | 9-5 | 0.287 | 11π/2 | 0.321 | 11π/2 | 0.373 | 11π/2 | B |
| | 9-6 | 0.392 | 15π/2 | 0.437 | 15π/2 | 0.509 | 15π/2 | B |
| | 9-7 | 0.496 | 19π/2 | 0.554 | 19π/2 | 0.645 | 19π/2 | C |
| | 9-8 | 0.131 | 5π/2 | 0.029 | π/2 | 0.034 | π/2 | B |

Example 10

In the present examples, an amorphous silicon photosensitive member including nine intermediate layers was produced using the same modified machine of the electrophotographic apparatus as in the examples 1. Note that the intermediate layers were set at the conditions shown in Table 13, and the function as an upper blocking layer was provided to the fourth intermediate layer. The other layers were set at the same conditions as in the examples 1. A single amorphous silicon photosensitive member was produced for each of the present examples. Each of the odd-numbered layers was adjusted such that its refractive index was the same as the geometrical mean of the refractive indices of the two even-numbered layers adjacent to the odd-numbered layer and such that its thickness was a thickness at which 4πnd/λ was the same as π. The thickness of each even-numbered layer was changed to the various conditions shown in Table 14. A variation in sensitivity in the amorphous silicon photosensitive member was evaluated by the method and criterion described in the evaluation 1 of the examples 1. The results of the evaluation are shown in Table 14.

The evaluation reveals that the example 10-1, where its even-numbered layers satisfy the conditions of the above expressions (8) and (9), achieved a good advantageous effect of suppressing a variation in sensitivity. The example 10-2, where its even-numbered layers satisfy the condition of the above expression (5), also achieved a good advantageous effect of suppressing a variation in sensitivity.

TABLE 13

| Formation Conditions | | Intermediate Layers 1st Layer | 2nd Layer | 3rd Layer | 4th Layer | 5th Layer | 6th Layer | 7th Layer | 8th Layer | 9th Layer |
|---|---|---|---|---|---|---|---|---|---|---|
| Gas Type and Flow Rate | | | | | | | | | | |
| $SiH_4$ | (ml/min.(normal)) | 360 | 310 | 270 | 230 | 185 | 135 | 80 | 65 | 45 |
| $CH_4$ | (ml/min.(normal)) | 50 | 120 | 170 | 230 | 310 | 380 | 450 | 730 | 1050 |
| $B_2H_6$ | (ppm (to $SiH_4$)) | 0 | 0 | 0 | 150 | 0 | 0 | 0 | 0 | 0 |
| Reaction Pressure | (Pa) | 50 | 50 | 50 | 50 | 50 | 50 | 50 | 50 | 50 |
| Electric Power | (W) | 400 | 400 | 400 | 400 | 400 | 400 | 400 | 400 | 400 |
| Temperature of Base | (° C.) | 230 | 230 | 230 | 230 | 230 | 230 | 230 | 230 | 230 |
| Refractive Index n | | 3.33 | 3.16 | 2.99 | 2.83 | 2.69 | 2.56 | 2.43 | 2.31 | 2.16 |
| Thickness d | (μm) | 0.050 | *Tab. 14 | 0.055 | *Tab. 14 | 0.061 | *Tab. 14 | 0.068 | *Tab. 14 | 0.076 |
| $4\pi nd/\lambda$ | | π | *Tab. 14 | π | *Tab. 14 | π | *Tab. 14 | π | *Tab. 14 | π |

TABLE 14

| | | 2nd Int. Layer Thickness d(μm) | 2nd Int. Layer $4\pi nd/\lambda$ | 4th Int. Layer Thickness d(μm) | 4th Int. Layer $4\pi nd/\lambda$ | 6th Int. Layer Thickness d(μm) | 6th Int. Layer $4\pi nd/\lambda$ | 8th Int. Layer Thickness d(μm) | 8th Int. Layer $4\pi nd/\lambda$ | Evaluation Results |
|---|---|---|---|---|---|---|---|---|---|---|
| Example | 10-1 | 0.031 | 3π/5 | 0.035 | 3π/5 | 0.039 | 3π/5 | 0.043 | 3π/5 | A |
| | 10-2 | 0.104 | 2π | 0.117 | 2π | 0.129 | 2π | 0.143 | 2π | A |

Example 11

In the present examples, an amorphous silicon photosensitive member including 11 intermediate layers was produced using the same modified machine of the electrophotographic apparatus as in the examples 1. Note that the intermediate layers were set at the conditions shown in Table 15, and the function as an upper blocking layer was provided to the sixth intermediate layer. The other layers were set at the same conditions as in the examples 1. A single amorphous silicon photosensitive member was produced for each of the present examples. Each of the odd-numbered layers was adjusted such that its refractive index was the same as the geometrical mean of the refractive indices of the two even-numbered layers adjacent to the odd-numbered layer and such that its thickness was a thickness at which $4\pi nd/\lambda$ was the same as π. The thickness of each even-numbered layer was changed to the various conditions shown in Table 16. A variation in sensitivity in the amorphous silicon photosensitive member was evaluated by the method and criterion described in the evaluation 1 of the examples 1. The results of the evaluation are shown in Table 16.

The evaluation reveals that the example 11-1, where its even-numbered layers satisfy the conditions of the above expressions (10) and (11), achieved a good advantageous effect of suppressing a variation in sensitivity. The example 11-2, where its even-numbered layers satisfy the condition of the above expression (5), also achieved a good advantageous effect of suppressing a variation in sensitivity.

TABLE 15

| Formation Conditions | | Intermediate Layers 1st Layer | 2nd Layer | 3rd Layer | 4th Layer | 5th Layer | 6th Layer | 7th Layer | 8th Layer | 9th Layer | 10th Layer | 11th Layer |
|---|---|---|---|---|---|---|---|---|---|---|---|---|
| Gas Type and Flow Rate | | | | | | | | | | | | |
| $SiH_4$ | (ml/min.(normal)) | 380 | 360 | 310 | 270 | 250 | 230 | 185 | 135 | 80 | 65 | 45 |
| $CH_4$ | (ml/min.(normal)) | 30 | 50 | 120 | 170 | 200 | 230 | 310 | 380 | 450 | 730 | 1050 |
| $B_2H_6$ | (ppm (to $SiH_4$)) | 0 | 0 | 0 | 0 | 0 | 150 | 0 | 0 | 0 | 0 | 0 |
| Reaction Pressure | (Pa) | 50 | 50 | 50 | 50 | 50 | 50 | 50 | 50 | 50 | 50 | 50 |
| Electric Power | (W) | 400 | 400 | 400 | 400 | 400 | 400 | 400 | 400 | 400 | 400 | 400 |
| Temperature of Base | (° C.) | 230 | 230 | 230 | 230 | 230 | 230 | 230 | 230 | 230 | 230 | 230 |
| Refractive index n | | 3.42 | 3.33 | 3.15 | 2.99 | 2.91 | 2.83 | 2.69 | 2.56 | 2.43 | 2.31 | 2.16 |

TABLE 15-continued

| Formation Conditions | | Intermediate Layers 1st Layer | 2nd Layer | 3rd Layer | 4th Layer | 5th Layer | 6th Layer | 7th Layer | 8th Layer | 9th Layer | 10th Layer | 11th Layer |
|---|---|---|---|---|---|---|---|---|---|---|---|---|
| Thickness d | (μm) | 0.048 | *Tab. 16 | 0.052 | *Tab. 16 | 0.057 | *Tab. 16 | 0.061 | *Tab. 16 | 0.068 | *Tab. 16 | 0.076 |
| 4πnd/λ | | π | *Tab. 16 | π | *Tab. 16 | π | *Tab. 16 | π | *Tab. 16 | π | *Tab. 16 | π |

TABLE 16

| | | 2nd Int. Layer | | 4th Int. Layer | | 6th Int. Layer | | 8th Int. Layer | | 10th Int. Layer | | |
|---|---|---|---|---|---|---|---|---|---|---|---|---|
| | | Thickness d(μm) | 4πnd/λ | Thickness d(μm) | 4πnd/λ | Thickness d(μm) | 4πnd/λ | Thickness d(μm) | 4πnd/λ | Thickness d(μm) | 4πnd/λ | Evaluation Results |
| Example | 11-1 | 0.017 | π/3 | 0.018 | π/3 | 0.019 | π/3 | 0.021 | π/3 | 0.024 | π/3 | A |
| | 11-2 | 0.099 | 2π | 0.110 | 2π | 0.117 | 2π | 0.129 | 2π | 0.143 | 2π | A |

Example 12

In the present example, an amorphous silicon photosensitive member including three intermediate layers was produced using the same modified machine of the electrophotographic apparatus as in the examples 1. Note that the intermediate layers and the surface layer were made of amorphous silicon nitride. A single amorphous silicon photosensitive member was produced under the conditions shown in Table 17. Each of the odd-numbered layers was adjusted such that its refractive index was the same as the geometrical mean of the refractive indices of the two even-numbered layers adjacent to the odd-numbered layer and such that its thickness was a thickness at which 4πnd/λ was the same as π. The thickness of each even-numbered layer was adjusted such that 4πnd/λ was the same as 2π. A variation in sensitivity in the amorphous silicon photosensitive member was evaluated by the method and criterion described in the evaluation 1 of the examples 1.

The evaluation was B, which reveals that a good effect was obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-114820 filed May 18, 2010 and No. 2011-088443 filed Apr. 12, 2011, which are hereby incorporated by reference herein in their entirety.

What is claimed is:

1. An electrophotographic apparatus comprising:

an electrophotographic photosensitive member including a photoconductive layer, a surface layer, and N intermediate layers disposed between the photoconductive layer and the surface layer, N being an odd number more than 2; and an image exposure apparatus for irradiating a surface of the electrophotographic photosensitive member with an image exposure beam having a central wavelength of λ [μm] and forming a latent image on the surface,

TABLE 17

| Formation Conditions | | Lower Blocking Layer | Photoconductive Layer | Intermediate Layers 1st Layer | 2nd Layer | 3rd Layer | Surface Layer |
|---|---|---|---|---|---|---|---|
| Gas Type and Flow Rate | | | | | | | |
| $SiH_4$ | (ml/min.(normal)) | 300 | 400 | 220 | 50 | 30 | 20 |
| $N_2$ | (ml/min.(normal)) | 0 | 0 | 20 | 50 | 180 | 300 |
| $H_2$ | (ml/min.(normal)) | 300 | 2000 | 0 | 0 | 0 | 0 |
| $B_2H_6$ | (ppm (to $SiH_4$)) | 0 | 0 | 0 | 150 | 0 | 0 |
| NO | (ml/min.(normal)) | 24 | 0 | 0 | 0 | 0 | 0 |
| Reaction Pressure | (Pa) | 40 | 70 | 50 | 50 | 50 | 50 |
| Electric Power | (W) | 500 | 1000 | 200 | 200 | 200 | 200 |
| Temperature of Base | (° C.) | 210 | 210 | 230 | 230 | 230 | 230 |
| Refractive Index n | | | 3.51 | 3.21 | 2.94 | 2.27 | 1.75 |
| Thickness d | (μm) | 3 | 30 | 0.051 | 0.112 | 0.073 | 0.5 |
| 4πnd/λ | | | | π | 2π | π | |

wherein, where $n_0$ is a refractive index of the photoconductive layer, $n_1$ is a refractive index of a first intermediate layer counting from the photoconductive layer side, $n_i$ is a refractive index of an ith intermediate layer counting from the photoconductive layer side, i being an integer equal to or more than 1 and equal to or less than N, $n_N$ is a refractive index of an Nth intermediate layer counting from the photoconductive layer side, $n_{N+1}$ is a refractive index of the surface layer, and $d_i$ is a thickness [μm] of the ith intermediate layer, the refractive indices $n_0$, $n_1$, $n_i$, $n_N$, and $n_{N+1}$ satisfy the following expression (1):

$$n_0>n_1>\ldots>n_i>\ldots>n_N>n_{N+1} \tag{1}$$

wherein, for each of odd-numbered intermediate layers counting from the photoconductive layer side, $n_{i-1}$ being the refractive index $n_0$ of the photoconductive layer when i is 1 and $n_{i+1}$ being the refractive index $n_{N+1}$ of the surface layer when i is N, the refractive index $n_i$ satisfies the following expression (2):

$$\left|\frac{n_i-\sqrt{n_{i-1}\cdot n_{i+1}}}{n_i}\right|\leq 0.02 \tag{2}$$

wherein, for each of the odd-numbered intermediate layers counting from the photoconductive layer side, there exists $p_i$ for enabling the refractive index $n_i$ and the thickness $d_i$ [μm], $p_i$ being a positive integer, to satisfy the following expression (3):

$$\left|\frac{4\pi\cdot n_i\cdot d_i}{\lambda}-(2\cdot p_i-1)\pi\right|\leq\frac{\pi}{16} \tag{3}$$

wherein, among combinations in which two intermediate layers are selected from the odd-numbered layers counting from the photoconductive layer side, there exists at least one combination at which q for enabling the sum of the products ($n_i\cdot d_i$) of the refractive indices $n_i$ and the thicknesses $d_i$ [μm] of one or more intermediate layers disposed between selected two intermediate layers, q being an integer equal to or more than 0, to satisfy the following expression (4):

$$\left|\frac{4\pi\cdot\sum n_i\cdot d_i}{\lambda}-2\pi\cdot q\right|<\frac{\pi}{2}. \tag{4}$$

2. The electrophotographic apparatus according to claim 1, wherein $p_i$ is 1 or 2.

3. The electrophotographic apparatus according to claim 1, wherein N is an odd number more than 4.

4. The electrophotographic apparatus according to claim 1, wherein, for one or more even-numbered layers counting from the photoconductive layer side, there exists $q_i$ for enabling the refractive index $n_i$ and the thickness $d_i$ [μm], $q_i$ being an integer equal to or more than 0, to satisfy the following expression (5):

$$\left|\frac{4\pi\cdot n_i\cdot d_i}{\lambda}-2\pi\cdot q_i\right|\leq\frac{\pi}{8}. \tag{5}$$

5. The electrophotographic apparatus according to claim 4, wherein $q_i$ is 1, 2, 3, or 4.

6. The electrophotographic apparatus according to claim 4, wherein N is an odd number more than 4, and wherein, for one or more even-numbered intermediate layers counting from the photoconductive layer side, there exists $q_i$ for enabling the refractive index $n_i$ and the thickness $d_i$ [μm], $q_i$ being an integer equal to or more than 0, to satisfy the above expression (5), and for the remaining one or more even-numbered intermediate layers, there exists $p_i$ for enabling the refractive index $n_i$ and the thickness $d_i$ [μm], $p_i$ being a positive integer, to satisfy the above expression (3).

7. The electrophotographic apparatus according to claim 4, wherein N is an integer that satisfies the following expression (6):

$$N=4\cdot k-1 \tag{6}$$

where k is a positive integer, and wherein, among combinations in which two even-numbered intermediate layers arranged substantially symmetrical with respect to a (2·k)th intermediate layer counting from the photoconductive layer side, there exists at least one combination at which the refractive index $n_i$ and the thickness $d_i$ [μm] of each of selected even-numbered intermediate layers satisfy the above expression (5).

8. The electrophotographic apparatus according to claim 1, wherein N is an integer that satisfies the following expression (7):

$$N=4\cdot h+1 \tag{7}$$

where h is a positive integer, and wherein, for each of even-numbered intermediate layers counting from the photoconductive layer side, there exists $s_i$ for enabling the refractive index $n_i$ and the thickness $d_i$ [μm], $s_i$ being a positive integer at which $(2\cdot s_i-1)/(2\cdot h+1)$ is not an odd number, to satisfy the following expression (8):

$$\left|\frac{4\pi\cdot n_i\cdot d_i}{\lambda}-\frac{(2\cdot s_i-1)\pi}{2\cdot h+1}\right|\leq\frac{\pi}{16}. \tag{8}$$

9. The electrophotographic apparatus according to claim 8, wherein $s_i$ is an integer that satisfies the following expression (9):

$$S_i=S_a+(2\cdot h+1)m_i \tag{9}$$

where $s_a$ is a positive integer at which $(2\cdot s_a-1)/(2\cdot h+1)$ is not an odd number and $m_i$ is an integer equal to or more than 0.

10. The electrophotographic apparatus according to claim 8, wherein $s_i$ is smaller than $(16\cdot h+9)/2$.

11. The electrophotographic apparatus according to claim 1, wherein N is an integer that satisfies the following expression (6):

$$N=4\cdot k-1 \tag{6}$$

where k is a positive integer, and wherein there exists $u_i$ for enabling the refractive index $n_i$ and the thickness $d_i$ [μm] of each of even-numbered intermediate layers counting from the photoconductive layer side, $u_i$ being a positive integer at which $u_i/(k+1)$ is not an odd number, to satisfy the following expression (10):

$$\left|\frac{4\pi \cdot n_i \cdot d_i}{\lambda} - \frac{\pi \cdot u_i}{k+1}\right| \leq \frac{\pi}{16}. \quad (10)$$

12. The electrophotographic apparatus according to claim 11, wherein $u_i$ is an integer that satisfies the following expression (11):

$$u_i = u_a + 2(k+1)v_i \quad (11)$$

where $u_a$ is a positive integer at which $u_a/(k+1)$ is not an odd number and $v_i$ is an integer equal to or more than 0.

13. The electrophotographic apparatus according to claim 11, wherein $u_i$ is equal to or less than 8(k+1).

14. The electrophotographic apparatus according to claim 1, wherein N is an odd number less than 12.

15. The electrophotographic apparatus according to claim 1, wherein the photoconductive layer comprises a layer including amorphous silicon, and each of the intermediate layers and the surface layer comprises a layer including amorphous silicon carbide or amorphous silicon nitride.

16. An electrophotographic photosensitive member comprising:

a photoconductive layer;

a surface layer on the photoconductive layer; and

N intermediate layers disposed between the photoconductive layer and the surface layer, N being an odd number more than 2, wherein the electrophotographic photosensitive member is an object irradiated with an image exposure beam having a central wavelength of λ [μm], wherein, where $n_0$ is a refractive index of the photoconductive layer, $n_1$ is a refractive index of a first intermediate layer counting from the photoconductive layer side, $n_i$ is a refractive index of an ith intermediate layer counting from the photoconductive layer side, i being an integer equal to or more than 1 and equal to or less than N, $n_N$ is a refractive index of an Nth intermediate layer counting from the photoconductive layer side, $n_{N+1}$ is a refractive index of the surface layer, and $d_i$ is a thickness [μm] of the ith intermediate layer counting from the photoconductive layer side, the refractive indices $n_0$, $n_1$, $n_i$, $n_N$, and $n_{N+1}$ satisfy the following expression (1):

$$n_0 > n_1 > \ldots > n_i > \ldots > n_N > n_{N+1} \quad (1)$$

wherein, for each of odd-numbered intermediate layers counting from the photoconductive layer side, $n_{i-1}$ being the refractive index $n_0$ of the photoconductive layer when i is 1 and $n_{i+1}$ being the refractive index $n_{N+1}$ of the surface layer when i is N, the refractive index $n_i$ satisfies the following expression (2):

$$\left|\frac{n_i - \sqrt{n_{i-1} \cdot n_{i+1}}}{n_i}\right| \leq 0.02 \quad (2)$$

wherein, for each of the odd-numbered intermediate layers counting from the photoconductive layer side, there exists $p_i$ for enabling the refractive index $n_i$ and the thickness $d_i$ [μm], $p_i$ being a positive integer, to satisfy the following expression (3):

$$\left|\frac{4\pi \cdot n_i \cdot d_i}{\lambda} - (2 \cdot p_i - 1)\pi\right| \leq \frac{\pi}{16} \quad (3)$$

wherein, among combinations in which two intermediate layers are selected from the odd-numbered layers counting from the photoconductive layer side, there exists at least one combination at which q for enabling the sum of the products ($n_i \cdot d_i$) of the refractive indices $n_i$ and the thicknesses $d_i$ [μm] of one or more intermediate layers disposed between selected two intermediate layers, q being an integer equal to or more than 0, to satisfy the following expression (4):

$$\left|\frac{4\pi \cdot \sum n_i \cdot d_i}{\lambda} - 2\pi \cdot q\right| < \frac{\pi}{2}. \quad (4)$$

17. The electrophotographic photosensitive member according to claim 16, wherein, for one or more even-numbered layers counting from the photoconductive layer side, there exists $q_i$ for enabling the refractive index $n_i$ and the thickness $d_i$ [μm], $q_i$ being an integer equal to or more than 0, to satisfy the following expression (5):

$$\left|\frac{4\pi \cdot n_i \cdot d_i}{\lambda} - 2\pi \cdot q_i\right| \leq \frac{\pi}{8}. \quad (5)$$

18. The electrophotographic photosensitive member according to claim 16, wherein N is an integer that satisfies the following expression (7):

$$N = 4 \cdot h + 1 \quad (7)$$

where h is a positive integer, and wherein, for each of even-numbered intermediate layers counting from the photoconductive layer side, there exists $s_i$ for enabling the refractive index $n_i$ and the thickness $d_i$ [μm], $s_i$ being a positive integer at which $(2 \cdot s_i - 1)/(2 \cdot h + 1)$ is not an odd number, to satisfy the following expression (8):

$$\left|\frac{4\pi \cdot n_i \cdot d_i}{\lambda} - \frac{(2 \cdot s_i - 1)\pi}{2 \cdot h + 1}\right| \leq \frac{\pi}{16}. \quad (8)$$

19. The electrophotographic photosensitive member according to claim 16, wherein N is an integer that satisfies the following expression (6):

$$N = 4 \cdot k - 1 \quad (6)$$

where k is a positive integer, and wherein there exists $u_i$ for enabling the refractive index $n_i$ and the thickness $d_i$ [μm] of each of even-numbered intermediate layers counting from the photoconductive layer side, $u_i$ being a positive integer at which $u_i/(k+1)$ is not an odd number, to satisfy the following expression (10):

$$\left|\frac{4\pi \cdot n_i \cdot d_i}{\lambda} - \frac{\pi \cdot u_i}{k+1}\right| \leq \frac{\pi}{16}. \quad (10)$$

20. An electrophotographic apparatus comprising:

an electrophotographic photosensitive member including a photoconductive layer, a surface layer, and N intermediate layers disposed between the photoconductive layer and the surface layer, N being an odd number more than 2; and an image exposure apparatus for irradiating a surface of the electrophotographic photosensitive member with an image exposure beam having a central wavelength of λ [μm] and forming a latent image on the surface, wherein, where $n_0$ is a refractive index of the photoconductive layer, $n_1$ is a refractive index of a first intermediate layer counting from the photoconductive layer side, $n_i$ is a refractive index of an ith intermediate layer counting from the photoconductive layer side, i being an integer equal to or more than 1 and equal to or less than N, $n_N$ is a refractive index of an Nth intermediate layer counting from the photoconductive layer side, $n_{N+1}$ is a refractive index of the surface layer, and $d_i$ is a thickness [μm] of the ith intermediate layer, the refractive indices $n_0$, $n_1$, $n_i$, $n_N$, and $n_{N+1}$ satisfy the following expression (1):

$$n_0 > n_1 > \ldots > n_i > \ldots > n_N > n_{N+1} \tag{1}$$

wherein, for each of odd-numbered intermediate layers counting from the photoconductive layer side, $n_{i-1}$ being the refractive index $n_0$ of the photoconductive layer when i is 1 and $n_{i+1}$ being the refractive index $n_{N+1}$ of the surface layer when i is N, the refractive index $n_i$ satisfies the following expression (2):

$$\left| \frac{n_i - \sqrt{n_{i-1} \cdot n_{i+1}}}{n_i} \right| \leq 0.02. \tag{2}$$

* * * * *